US007331648B2

(12) United States Patent
Niekawa

(10) Patent No.: US 7,331,648 B2
(45) Date of Patent: Feb. 19, 2008

(54) INK JET RECORDING APPARATUS, RECORDING HEAD AND INK JET RECORDING METHOD

(75) Inventor: Yukihiro Niekawa, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 416 days.

(21) Appl. No.: 11/055,212

(22) Filed: Feb. 10, 2005

(65) Prior Publication Data

US 2006/0012631 A1 Jan. 19, 2006

(30) Foreign Application Priority Data

Jul. 14, 2004 (JP) ..... 2004-207594
Dec. 7, 2004 (JP) ..... 2004-354221

(51) Int. Cl.
*B41J 2/145* (2006.01)
*B41J 2/15* (2006.01)

(52) U.S. Cl. ..... 347/41; 347/43
(58) Field of Classification Search ..... 347/40–43, 347/15
See application file for complete search history.

(56) References Cited

U.S. PATENT DOCUMENTS 6,302,517 B1 * 10/2001 Kanaya ..... 347/41
6,416,162 B1 * 7/2002 Otsuki ..... 347/41

FOREIGN PATENT DOCUMENTS

| | | | |
|---|---|---|---|
| JP | 62-290553 | A | 12/1987 |
| JP | 09-020005 | A | 1/1997 |
| JP | 2002-137388 | A | 5/2002 |
| JP | 2002-225265 | A | 8/2002 |
| JP | 2002-264371 | A | 9/2002 |
| JP | 2002-326687 | A | 11/2002 |
| JP | 2003-053957 | A | 2/2003 |
| JP | 2004-167812 | A | 6/2004 |

* cited by examiner

*Primary Examiner*—Thinh Nguyen
(74) *Attorney, Agent, or Firm*—Frishauf, Holtz, Goodman & Chick, P.C.

(57) ABSTRACT

An ink jet recording apparatus having: a recording head having a plurality of nozzles formed thereon to jet ink; a feeding device to feed a recording medium; and a control unit to control ink jetting from the nozzles of the recording head so that the recording head is driven with multi-phase drive to record with recorded pixel locations shifted at every drive phase switching by an integer times a pixel width of a recording resolution.

6 Claims, 22 Drawing Sheets

DOTS PRINTED BY NOZZLE COLUMN 18a
DOTS PRINTED BY NOZZLE COLUMN 18b
DOTS PRINTED BY NOZZLE COLUMN 18c

INK JET RECORDING APPARATUS, RECORDING HEAD AND INK JET RECORDING METHOD

BACKGROUND OF THE INVENTION

1. Field of the Invention

The present invention relates to an ink jet recording apparatus, a recording head and an ink jet recording method, and more particularly to an ink jet recording apparatus that employs a recording head for multi-phase drive and an ink jet recording method using this apparatus.

2. Description of the Related Art

There has been known an ink jet recording apparatus as a recording apparatus capable of printing on various kinds of recording mediums, such as standard paper and the like. The ink jet recording apparatus jets ink, serving as a coloring agent, directly on a recording medium from nozzles mounted on the surface of a recording head opposing to the recording medium, the ink landing, being absorbed or fixed on the medium, to thus form an image on the recording medium. The ink jet recording apparatus has several superior advantages, such as simple processing, quietness at the time of printing, and high print-quality of characters and images.

Some ink jet recording apparatuses have high density of nozzles on a recording head for obtaining high quality images. However, as the recording head has higher density of nozzles, the number of nozzles simultaneously driven becomes larger, which increases the current flowing at the leading edge of drive, to thereby increase the load in drive circuits for the recording head.

In order to reduce the load in drive circuits of the recording head, there has been known some ink jet recording apparatuses in which aligned nozzles on a recording head are driven at different timings from each other for printing (refer to JP-Tokukai-2002-137388 and JP-Tokukai-2003-326687). JP-Tokukai-2002-137388 discloses a recording head in which two columns of nozzles are arranged in parallel in a main scanning direction, and three nozzles arranged in a sub scanning direction on a column are driven with three phases, that is, phase 1, phase 2 and phase 3, respectively. A printer head disclosed in JP-Tokukai-2003-326687 also uses 3-phase drive in which nozzles are driven in order of A, B, and C.

In an ink jet recording apparatus having such a recording head for 3-phase drive, nozzles on the recording head are generally arranged with displacement in the main scanning direction for respective phases. This is what is called staggered arrangement, and jetting of ink from the nozzles has been controlled so as to record at periods as shown in FIG. 28. In FIG. 28, a nozzle 100*a* is controlled to be driven in phase 1, a nozzle 100*b* in phase 2, and a nozzle 100*c* in phase 3. STB1 shows a strobe (STB) pulse for switching the phase for nozzle 100*a*, STB2 for nozzle 100*b*, and STB3 for nozzle 100*c*.

The nozzles 100*a*, 100*b* and 100*c* for respective phases are controlled to switch the phase at either timing of the strobe pulse width. Switching of phases corresponds to a frequency, and the strobe pulse width corresponds to a period of each phase. In a conventional recording method, the strobe pulse has switched the drive phases three times within one pixel time so that the nozzles 100*a*, 100*b* and 100*c* driven in phase 1, phase 2 and phase 3, respectively, can record the pixels in a straight line in the sub scanning direction.

According to such phase switching, when the nozzles 100*a*, 100*b* and 100*c* jet ink in this order from the upstream in the main scanning direction, the nozzle 100*b* in phase 2 jets ink later than the nozzle 100*a* in phase 1, but because of reverse displacement of nozzle 100*b* by a staggered pitch in the main scanning direction, its movement needs longer time by the staggered pitch, so that a recorded pixel by nozzle 100*b* has been resultantly recorded adjacent to the pixel jetted by nozzle 100*a* in the sub scanning direction. Similarly, although the nozzle 100*c* in phase 3 jets ink later than the nozzle 100*b* in phase 2 because of reverse displacement of nozzle 100*c* by a staggered pitch in the main scanning direction, its movement needs longer time by the staggered pitch, so that a recorded pixel by nozzle 100*c* has been recorded adjacent to the pixel jetted by nozzle 100*b* in the sub scanning direction. Thus, the conventional ink jet recording apparatus has recorded pixels in a straight line utilizing the staggered pitch between nozzles.

Such an ink jet recording apparatus has recorded pixels with such a method as shown in FIG. 29. That is, in a first scanning (also referred to as "first pass"), each of three groups of nozzles (G1-3), which adopts 3-phase drive, records pixels in a straight line in the sub scanning direction with the nozzles driven in the order of phase 1, phase 2 and phase 3. Then a recording head 6 is moved in the main scanning direction. Thereafter, a second scanning repeats the same operation as in the first scanning, and so does a third scanning.

Thus, when the staggered nozzles on a recording head are driven with a time difference at every phase, even if nozzles in phase 2 are driven later than those in phase 1, and nozzles in phase 3 later than those of phase 2, the time to be recorded is adjusted by each additional time for nozzles in phase 2 and phase 3 to move by the staggered pitch width, so that every phase of nozzles could record pixels on a straight line in the sub scanning direction.

In the present application, the upstream in the main scanning direction in a serial-type recording head having staggered nozzles means the front side thereof, and the downstream the rear side thereof. In FIG. 28, for example, when the head scans toward the right from the left, an upstream nozzle in the main scanning direction is 100*a*, and a downstream nozzle 100*c*, and when the head scans toward the left from the right, an upstream nozzle in the main scanning direction is 100*c* and a downstream nozzle 100*a*.

However, when pixels are recorded in a straight line using staggered nozzles on a recording head with multi-phase drive as in the conventional printer, each phase has to be switched within one pixel time, so that the carriage speed in the main scanning direction has been limited by nozzle-drive frequency of the recording head. In other words, the fewer number of drive phases make the less number of switching of strobe pulses, which causes strobe pulse width to the one pixel time (pixel clock) to be relatively wider, allowing relatively higher carriage speed. On the other hand, the larger number of drive phases need the larger number of switching of strobe pulses, which causes strobe pulse width to be relatively narrower, resulting in relatively lower carriage speed.

The carriage speed in the main scanning direction has been also limited by the staggered pitch between nozzles on a recording head. That is, one pixel has to be recorded while a nozzle on the head moves by the staggered pitch, so that the nozzle moves at the most by the staggered pitch in the time necessary for jetting ink for one pixel. Accordingly, the upper limit of carriage speed has been the value of a staggered pitch divided by the time necessary for jetting ink for one pixel.

However, the larger staggered pitch makes the size of recording head larger, and also causes a problem in that it needs a new manufacturing technology for producing recording heads having a larger staggered pitch.

As described above, an ink jet recording apparatus, having staggered nozzles on the head with multi-phase drive, is limited in achieving higher carriage speed, because the carriage speed limitation depends on the nozzle-drive frequency and the staggered pitch.

In conventional serial type ink jet recording apparatuses, a multi-pass recording method has been widely used. In this recording method, a column of nozzles are divided into a few blocks of nozzles, and image data to be recorded are allotted and distributed into these blocks of nozzles with intermittent feeding of paper for each block to complete this image recording. According to this multi-pass recording method, pixels on one same line, which are naturally recorded by one same nozzle, are divided into plural blocks, and each block is recorded by mutually different nozzles. Therefore, even if there exist misalignment of nozzles, or ink jet failure in some nozzles, these irregularities could be made averaged, and perceived as unnoticeable misalignment of recorded pixels. Thus, serial type ink jet recording apparatuses have been supposed to apply multi-pass scanning of a carriage.

To the contrary, line-type ink jet recording apparatuses, which employ recording heads for multi-phase drive, also have the same problems as in the serial-type ink jet recording apparatuses. That is, when the multi-phase drive recording head having staggered nozzles thereon records pixels in a straight line, each phase of the nozzles has to be switched within one pixel time, whereby the feeding speed of a print medium in a feeding direction is limited by nozzle-drive frequency of the recording head. The fewer number of drive phases allow the feeding speed to be higher, and the larger number of drive phases make the feeding speed relatively lower.

The feeding speed is also limited by a staggered pitch, and the upper limit of feeding speed is the value of a staggered pitch divided by the time necessary for jetting ink for one pixel. However, the larger staggered pitch makes the size of recording head larger.

As described above, if pixels were recorded in a line using the multi-phase drive recording head having staggered nozzles thereon, the recording speed has been inevitably limited in both line type and serial type ink jet recording apparatuses, because the feeding speed or carriage speed, i.e., recording speed depends on the nozzle-drive frequency and the staggered pitch.

SUMMARY OF THE INVENTION

In accordance with the first aspect of the present invention, the ink jet recording apparatus comprises:

a recording head comprising a plurality of nozzles formed thereon to jet ink;

a feeding device to feed a recording medium; and a control unit to control ink jetting from the nozzles of the recording head so that the recording head is driven with multi-phase drive to record with recorded pixel locations shifted at every drive phase switching by an integer times a pixel width of a recording resolution.

According to the first aspect of the present invention, in the case that the recording head is driven with multi-phase drive, recording is performed with the recorded pixel locations shifted in the main scanning direction in the serial type and with the recorded pixel locations shifted in the feeding direction of the recording medium in the line type. Thus, as in a conventional recording apparatus, it is not necessary to switch each phase within one-pixel time, so that the strobe pulse width of each phase can be made wider relative to a pixel clock, allowing each phase of period for driving the nozzles to be longer. Even in the case of increasing the number of the drive phase, by increasing the shifted number of pixels and the number of scanning of the recording head, the strobe pulse width of each phase can be made wider relative to a pixel clock, allowing each phase of period for driving the nozzles to be longer.

Therefore, since it is not necessary to switch each phase within one-pixel time, carriage speed in the serial type or feeding speed of the recording medium in the line type, that is, the recording speed does not depend on a staggered pitch as in the conventional apparatus. Thus, the recording speed can be increased. For recording images with high quality, nozzles on the recording head need to be arranged in high density, however, even in this case, high quality images can be obtained with improved productivity, by applying multi-phase drive with the recorded pixel locations shifted at every drive-phase switching.

In accordance with the second aspect of the present invention, the ink jet recording apparatus comprises:

a serial-type recording head comprising a plurality of nozzles to jet ink;

a main scanning mechanism to reciprocate the recording head in a main scanning direction;

a feeding device to feed a recording medium in a sub scanning direction perpendicular to the main scanning direction; and a control unit to control ink jetting from the nozzles of the recording head so that the recording head is driven with multi-phase drive to record with recorded pixel locations shifted at every drive phase switching by an integer times a pixel width of a recording resolution in the main scanning direction, and to record by plural times of scanning with the recording medium fed by the feeding device.

According to the second aspect of the present invention, it is not necessary to switch each phase within one-pixel time even when the recording head is driven with multi-phase drive, so that carriage speed does not depend on a staggered pitch.

Moreover, since the strobe pulse width can be made wider relative to a pixel clock, carriage speed can be increased when the strobe pulse is constant.

Therefore, even when the recording head has nozzles with high density, high quality images can be obtained by applying multi-phase drive and plural times of scanning of the head with the recorded pixel locations shifted at every drive-phase switching in the main scanning direction.

Preferably, the control unit controls the ink jetting such that, a recorded pixel location X which indicates where a recorded pixel is located from a reference position in the main scanning direction when an arbitrary pixel as the reference position is set to one is given by $$X=\{(i-1)\times f+P-1\}\times D+1,$$

and the number of scanning S of the recording head is given by $$S=f\times D\times R_p/R_n$$

or $$S=f\times D\times P_n/P_p$$

where i is the number of a pixel when counted from the reference position out of pixels recorded by the same nozzle in the main scanning direction, D is the shifted number of pixels in the main scanning direction at every phase of recorded pixels (by a unit of the number of pixels in the recording resolution), f is the number of head-drive phases, P is a drive phase number (a phase number allotted from P=1 to P=f in the order of drive, designating a drive phase to record a pixel at the reference position as P=1), S is the number of scanning of the recording head, $R_n$ is a resolution of the head in the sub scanning direction, $R_p$ is a recording resolution in the sub scanning direction, $P_n$ is a mean pitch between adjacent nozzles in the sub scanning direction, and $P_p$ is a recorded pixel pitch in the sub scanning direction.

Accordingly, by expressing the recorded pixel locations and the number of scanning of the recording head by the above expressions, the same effects as in the second aspect of the present invention can be achieved.

In accordance with the third aspect of the present invention, the ink jet recording apparatus comprises:

a serial-type recording head comprising a plurality of nozzles to jet ink;

a main scanning mechanism to reciprocate the recording head in a main scanning direction;

a feeding device to feed a recording medium in a sub scanning direction perpendicular to the main scanning direction; and a control unit to control ink jetting from the nozzles of the recording head so that the recording head is driven with multi-phase drive to record with recorded pixel locations shifted at every drive phase switching by an integer times a pixel width of a recording resolution in the main scanning direction, wherein the recording head comprises nozzle columns of multiples of the number of drive phases, which comprise the nozzles jetting the same kind of ink, and nozzle positions of each of the nozzle columns correspond to each other in the main scanning direction, and the control unit controls to record such that the nozzles on different nozzle columns of the recording head jet ink onto different recorded pixel locations.

According to the third aspect of the present invention, the recording head comprises nozzle columns of multiples of the number of drive phases, which comprise the nozzles jetting the same kind of ink, nozzle positions of each of the nozzle columns corresponding to each other in the main scanning direction, and recording is performed such that the nozzles on different nozzle columns of the recording head jet ink onto different recorded pixel locations. Thus, all pixels, covered with the recording width of the head in the sub scanning direction, can be recorded by one time scanning of the recording head.

Moreover, the same effects as in the second aspect of the present invention can be achieved. At the same time, when one image is recorded by multiple scanning, there are sometimes found displacement in the main scanning direction due to reciprocating scanning of the recording head, slanting movement of the recording medium, misalignment of head assembling, or the like, which is possible to cause fluctuation in a vertical direction (sub scanning direction) in the image recorded on the medium, that is, distortion in right-and-left direction on inherently straight lines. However, it is possible, in the invention, to record all pixels covered with the recording width of the head in the sub scanning direction by one time scanning of the head in the main scanning direction. This recording by one time scanning can effectively suppress fluctuation in the image, thereby obtaining high quality images with improved productivity.

Preferably, the control unit controls to record all pixels covered with a recording width by one time scanning of the recording head in the main scanning direction.

Accordingly, it is possible that the recording head comprises nozzle columns of multiples of the number of drive phases, which comprise the nozzles jetting the same kind of ink, nozzle positions of each of the nozzle columns correspond to each other in the main scanning direction, recording is performed such that the nozzles on different nozzle columns of the recording head jet ink onto different recorded pixel locations, allowing all pixels, covered with the recording width of the head in the sub scanning direction, recorded by one time scanning of the recording head. Therefore, the fluctuation in the image can effectively suppress, so that the same effects as in the third aspect of the present invention can be achieved more efficiently.

Preferably, a distance between the nozzle columns of the recording head is set to (a pixel pitch in the main scanning direction) times (n times the number of drive phases plus one), where n is a natural number.

Accordingly, in the recording head, for example, when the number of drive phases is three, a distance between the nozzle columns is four times, seven times of the pixel pitch or the like, and when the number of drive phases is four, a distance between the nozzle columns is five times, nine times of the pixel pitch or the like. Thus, even when the same STB signal is applied to each nozzle column, ink jetted from the nozzles on different nozzle columns does not placed on the same recorded pixel locations. Moreover, it is possible to record the pixel locations next to the pixel locations which was recorded by the nozzles on the adjacent nozzle column, so that the effects in the third aspect of the present invention can be certainly achieved.

In accordance with the fourth aspect of the present invention, the ink jet recording apparatus comprises:

line-type recording heads each comprising a plurality of nozzles formed thereon to jet ink;

a feeding device to feed a recording medium in a feeding direction; and a control unit to control ink jetting from the nozzles of each of the recording heads so that the recording heads are driven with multi-phase drive to record with recorded pixel locations shifted at every drive phase switching by an integer times a pixel width of a recording resolution in the feeding direction, and to record by the plurality of recording heads with the recording medium fed by the feeding device.

According to the fourth aspect of the present invention, even in the case of the ink jet recording apparatus comprising line type heads, it is not necessary to switch each phase within one-pixel time when the recording heads are driven with multi-phase drive, so that feeding speed of the recording medium does not depend on a staggered pitch.

Moreover, since the strobe pulse width can be made wider relative to a pixel clock, feeding speed can be increased when the strobe pulse is constant.

Therefore, even when each recording head has nozzles with high density, high quality images can be obtained by applying multi-phase drive and recording with the recorded pixel locations shifted at every drive-phase switching in the feeding direction.

In accordance with the fifth aspect of the present invention, the ink jet recording apparatus comprises:

a line-type recording head comprising a plurality of nozzles formed thereon to jet ink;

a feeding device to feed a recording medium in a feeding direction; and a control unit to control ink jetting from the nozzles of the recording head so that the recording head is driven with multi-phase drive to record with recorded pixel locations shifted at every drive phase switching by an integer times a pixel width of a recording resolution in the feeding direction, and to record with the recording medium fed by the feeding device, wherein the recording head comprises nozzle rows of multiples of the number of drive phases, which comprise the nozzles jetting the same kind of ink, and nozzle positions of each of the nozzle rows correspond to each other in the feeding direction, and the control unit controls to record such that the nozzles on different nozzle rows of the recording head jet ink onto different recorded pixel locations.

According to the fifth aspect of the present invention, although ink jet recording is performed in the same manner as in the fourth aspect of the present invention, the recording head comprises nozzle rows of multiples of the number of drive phases, which comprise the nozzles jetting the same kind of ink, nozzle positions of each of the nozzle rows corresponding to each other in the feeding direction, and recording is performed such that the nozzles on different nozzle rows of the recording head jet ink onto different recorded pixel locations. Thus, even in the case of the line type ink jet recording apparatus, all pixels are recorded on the medium fed under the facing surface of the recording head, enabling to certainly achieve the effects in the fourth aspect of the present invention.

Preferably, a distance between the nozzle rows of the recording head is set to (a pixel pitch in the feeding direction) times (n times the number of drive phases plus one), where n is a natural number.

Accordingly, in the recording head, for example, when the number of drive phases is three, a distance between the nozzle rows is four times, seven times of the pixel pitch or the like, and when the number of drive phases is four, a distance between the nozzle rows is five times, nine times of the pixel pitch or the like. Thus, even when the same STB signal is applied to each nozzle row, ink jetted from the nozzles on different nozzle rows does not placed on the same recorded pixel locations. Moreover, it is possible to record the pixel locations next to the pixel locations which was recorded by the nozzles on the adjacent nozzle row, so that the effects in the fifth aspect of the present invention can be certainly achieved.

Preferably, the nozzles of the recording head are aligned.

Accordingly, carriage speed or feeding speed of the recording medium does not depend on a staggered pitch, but depend on a pixel pitch. That is, the staggered pitch is usually about ten micron, and given by (pixel pitch in the main scanning direction or the feeding direction/the number of drive phases). Accordingly, if the pixel pitch in the main scanning direction or the feeding direction is one inch (25400 μm)/720 dpi, and the number of phases is three, then the staggered pitch is 11.759 μm. Also, a pixel pitch is one inch (25400 μm)/720 dpi=35.278 μm. Thus, the pixel pitch is three times of the staggered pitch, and therefore the upper limit of carriage speed or feeding speed of the recording medium is permitted three times higher than conventional one.

Preferably, the nozzles of the recording head are staggered so that the nozzles are displaced in the main scanning direction for every drive phase.

Accordingly, the same effects as in each of the above aspect of the present invention can be achieved. Moreover, since the recording head in which the nozzles are staggered is used, the recording mode in the conventional ink jet recording apparatus can be easily used only by a mode switching.

In the case of the nozzles in the 3-phase drive, an actual pitch is given by a difference between the above described pixel pitch and the staggered pitch, that is, 35.278−11.759=23.519 μm. This is two times the staggered pitch, and therefore the recording method according to the invention can achieve two times higher upper limit of carriage speed than conventional one.

Similarly, if the drive phase is four or five, the actual pitch becomes three or four times the staggered pitch, respectively, that is, the upper limit of carriage speed can be attained by (the number of drive phases minus one) times the conventional one.

Preferably, the control unit drives the nozzles of the recording head from a nozzle arranged at downstream in the main scanning direction sequentially with the drive phase switching.

Accordingly, abrupt switching for each phase is not needed to be in time for recording. Therefore each phase of period can take longer time, resulting in higher carriage speed of the recording medium.

Preferably, the nozzles of each of the recording heads are staggered so that the nozzles are displaced in the feeding direction for every drive phase.

Accordingly, the same effects as in the fourth and fifth aspects of the present invention can be achieved. Moreover, since the recording head in which the nozzles are staggered is used, the recording mode in the conventional ink jet recording apparatus can be easily used only by a mode switching.

In the case of the nozzles in the 3-phase drive, an actual pitch is given by a difference between the above described pixel pitch and the staggered pitch, that is, 35.278−11.759=23.519 μm. This is two times the staggered pitch, and therefore the recording method according to the invention can achieve two times higher upper limit of feeding speed than conventional one.

Similarly, if the drive phase is four or five, the actual pitch becomes three or four times the staggered pitch, respectively, that is, the upper limit of feeding speed can be attained by (the number of drive phases minus one) times the conventional one.

Preferably, the control unit drives the nozzles of each of the recording heads from a nozzle arranged at downstream in the feeding direction sequentially with the drive phase switching.

Accordingly, abrupt switching for each phase is not needed to be in time for recording. Therefore each phase of period can take longer time, resulting in higher feeding speed of the recording medium.

Preferably, the control unit switches the drive phases such that, when a period to switch each drive phase is given by T, a clock period to record a pixel by T', and the number of drive phases by f, then $$T=T\times\{(D-1)+(f-1)/f\}.$$

Accordingly, it has found out that the drive phase switching period can be expressed by the above expression.

Preferably, the control unit drives the recording head with three-phase drive.

Accordingly, by using the recording head of the 3-phase drive, the same effects as in each of the above aspect of the present invention can be achieved.

In accordance with the sixth aspect of the present invention, the recording head drivable with multi-phase drive, comprises: nozzle columns of multiples of the number of drive phases, which comprise the nozzles jetting the same kind of ink, wherein nozzle positions of each of the nozzle columns correspond to each other in a main scanning direction, and the nozzles on different nozzle columns are allowed to jet ink onto different recorded pixel locations.

In accordance with the seventh aspect of the present invention, the recording head drivable with multi-phase drive, comprises: nozzle rows of multiples of the number of drive phases, which comprise the nozzles jetting the same kind of ink, wherein nozzle positions of each of the nozzle rows correspond to each other in a feeding direction, and the nozzles on different nozzle rows are allowed to jet ink onto different recorded pixel locations.

Preferably, the nozzles are aligned on each of the nozzle columns or the nozzle rows.

Preferably, the nozzles of each of the nozzle columns are staggered so that the nozzles are displaced in the main scanning direction for every drive phase.

Preferably, the nozzles of each of the nozzle rows are staggered so that the nozzles are displaced in the feeding direction for every drive phase.

Preferably, a distance between the nozzle columns is set to (a pixel pitch in the main scanning direction) times (n times the number of drive phases plus one), where n is a natural number.

Preferably, a distance between the nozzle rows is set to (a pixel pitch in the feeding direction) times (n times the number of drive phases plus one), where n is a natural number.

In accordance with the eighth aspect of the present invention, the ink jet recording method comprises:

switching drive phases of a recording head comprising a plurality of nozzles formed thereon;

determining recorded pixel locations with the pixel locations to be recorded by the nozzles of the recording head shifted at every drive-phase switching of the recording head by an integer times a pixel width of a recording resolution; and jetting ink from the nozzles of the recording head to record on the recorded pixel locations.

In accordance with the ninth aspect of the present invention, the ink jet recording method comprises:

switching drive phases of a serial-type recording head comprising a plurality of nozzles formed thereon;

determining recorded pixel locations with the pixel locations to be recorded by the nozzles of the recording head shifted at every drive-phase switching of the recording head by an integer times a pixel width of a recording resolution in a main scanning direction; and jetting ink from the nozzles of the recording head to record on the recorded pixel locations while scanning the recording head plural times in the main scanning direction with the recording medium fed by the feeding device.

Preferably, the determining recorded pixel locations is such that, a recorded pixel location X which indicates where a recorded pixel is located from a reference position in the main scanning direction when an arbitrary pixel as the reference position is set to one is given by $$X=\{(i-1)\times f+P-1\}\times D+1,$$

and the number of scanning S of the recording head is given by $$S=f\times D\times R_p/R_n$$

or $$S=f\times D\times P_n/P_p$$

where i is the number of a pixel when counted from the reference position out of pixels recorded by the same nozzle in the main scanning direction, D is the shifted number of recorded pixels in the main scanning direction at every phase (by a unit of the number of pixels in the recording resolution), f is the number of head-drive phases, P is a drive phase number (a phase number allotted from P=1 to P=f in the order of drive, designating a drive phase to record a pixel at the reference position as P=1), S is the number of scanning of the recording head, $R_n$ is a resolution of the head in the sub scanning direction, $R_p$ is a recording resolution in the sub scanning direction, $P_n$ is a mean pitch between adjacent nozzles in the sub scanning direction, and $P_p$ is a recorded pixel pitch in the sub scanning direction.

In accordance with the tenth aspect of the present invention, An ink jet recording method comprises:

switching drive phases of a serial-type recording head in which nozzle positions of each of nozzle columns of multiples of the number of drive phases correspond to each other in a main scanning direction, the nozzle columns comprising a plurality of nozzles jetting the same kind of ink;

determining recorded pixel locations with the pixel locations to be recorded by the nozzles of the recording head shifted at every drive-phase switching of the recording head by an integer times a pixel width of a recording resolution in a main scanning direction; and jetting ink from the nozzles of the recording head with scanning of the recording head in the main scanning direction so that ink jetting from the nozzles on different nozzle columns of the recording head records onto different recorded pixel locations.

Preferably, the jetting ink is performed so that all pixels covered with a recording width by one time scanning of the recording head in the main scanning direction is recorded.

Preferably, the switching drive phases is performed in the recording head so that a distance between the nozzle columns of the recording head is set to (a pixel pitch in the main scanning direction) times (n times the number of drive phases plus one), where n is a natural number.

In accordance with the eleventh aspect of the present invention, the ink jet recording method comprises:

switching drive phases of a line-type recording head comprising a plurality of nozzles formed thereon;

determining recorded pixel locations with the pixel locations to be recorded by the nozzles of the recording head shifted at every drive-phase switching of the recording head by an integer times a pixel width of a recording resolution in a feeding direction; and jetting ink from the nozzles of the recording head to record on the recorded pixel locations with the recording medium fed in the feeding direction.

In accordance with the twelfth aspect of the present invention, the ink jet recording method comprises:

switching drive phases of a line-type recording head in which nozzle positions of each of nozzle rows of multiples of the number of drive phases correspond to each other in a feeding direction, the nozzle rows comprising a plurality of nozzles jetting the same kind of ink;

determining recorded pixel locations with the pixel locations to be recorded by the nozzles of the recording head shifted at every drive-phase switching of the recording head by an integer times a pixel width of a recording resolution in the feeding direction; and jetting ink from the nozzles of the recording head with feeding the recording medium in the feeding direction so that ink jetting from the nozzles on different nozzle rows of the recording head records onto different recorded pixel locations.

Preferably, the switching drive phases is performed in the recording head so that a distance between the nozzle rows of the recording head is set to (a pixel pitch in the feeding direction) times (n times the number of drive phases plus one), where n is a natural number.

Preferably, the jetting ink is performed so that the ink is jetted from aligned nozzles arranged on the recording head.

Preferably, the jetting ink is performed so that the ink is jetted from staggered nozzles arranged on the recording head with the nozzles displaced in the main scanning direction for every drive phase.

Preferably, the switching drive phases is performed so that drive phases of the nozzles on the recording head are sequentially switched from a nozzle arranged at downstream side in the main scanning direction.

Preferably, the jetting ink is performed so that the ink is jetted from staggered nozzles arranged on the recording head with the nozzles displaced in the feeding direction for every drive phase.

Preferably, the switching drive phases is performed so that drive phases of the nozzles on the recording head are sequentially switched from a nozzle arranged at downstream side in the feeding direction.

Preferably, the switching drive phases is performed to switch the drive phases such that, when a period to switch each drive phase is given by T, a clock period to record a pixel by T', and the number of drive phases by f, then $$T=T\times\{(D-1)+(f-1)/f\}.$$

Preferably, the switching drive phases is performed by driving the recording head with three-phase drive.

BRIEF DESCRIPTION OF THE DRAWINGS

The present invention will become more fully understood from the detailed description and accompanying drawings given below, but these are not intended to limit the present invention, and wherein.

DETAILED DESCRIPTION OF THE PREFERRED EMBODIMENTS a. First Embodiment

A first embodiment of the invention will now be explained with reference to FIGS. 1 to 7.

Figure 1:
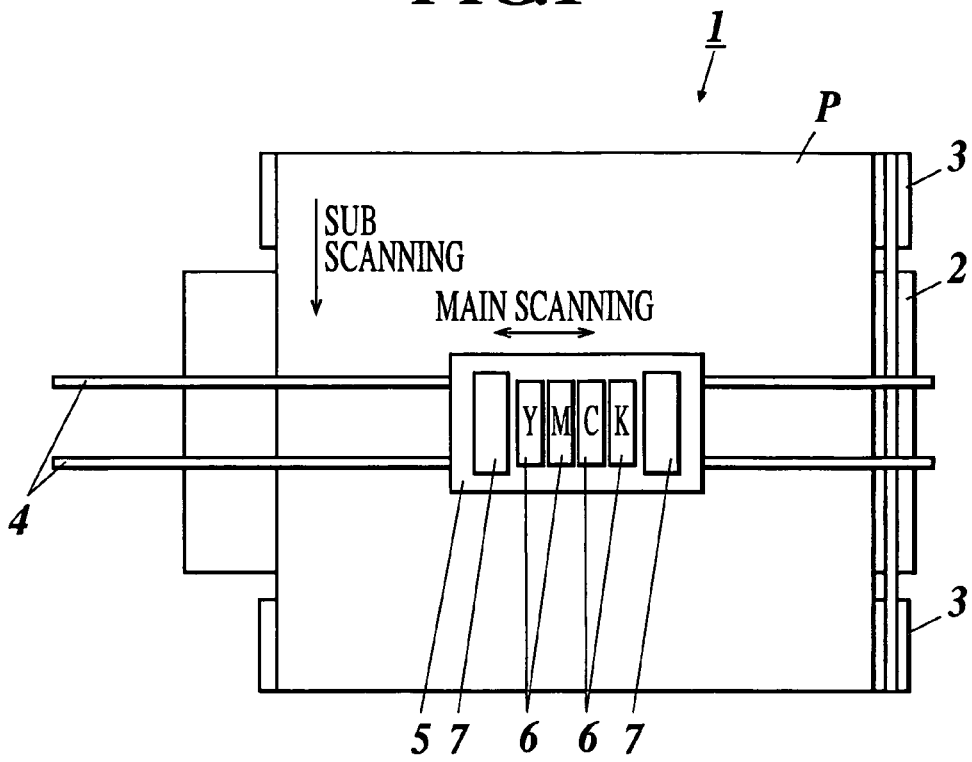
FIG. 1 is a plan view showing the schematic construction of an ink jet recording apparatus according to a first embodiment of the present invention.

FIG. 1 shows the schematic construction of an ink jet recording apparatus 1 according to the embodiment.

The ink jet recording apparatus 1 is a serial type ink jet recording apparatus in which recording heads 6 scan in a direction (main scanning direction) perpendicular to a feeding direction of a recording medium P with the jetting of ink droplets during head movement to form images. This ink jet recording apparatus 1 has a platen 2 supporting the medium P from its underside as shown in FIG. 1. There are provided with feeding devices 3, each device including a roller for feeding the medium P, at the upstream and downstream sides in the medium feeding direction (sub scanning direction) of the platen 2 so as to dispose the platen 2 between them. Provided over the platen 2 is a pair of guide rails 4 extending in the main scanning direction. The guide rails 4 support thereon a carriage 5 reciprocally movable in the main scanning direction.

Mounted on the carriage 5 are a plurality of serial type recording heads 6 for jetting respective colored inks (the colors of yellow (Y), magenta (M), cyan (C), and black (K)) so that the ink jetting surface of each head 6 faces the medium P supported on the platen 2.

The ink jet recording apparatus of the invention preferably uses photo curable ink, including radical polymerized type ink, cationic polymerized type ink or hybrid type ink, which is cured by ultraviolet irradiation. It is particularly preferable in the embodiment to use energy accumulating type cationic polymerized type ink, which is little affected by oxygen in the polymerization reaction and curable by longer irradiation time even if low illuminance of ultraviolet rays are used.

The carriage 5 also has irradiating devices 7 at both sides of the recording heads 6 for curing the ink deposited on the recording medium P by irradiation of light. As a light source provided within the irradiating device 7, there may be used a fluorescent lamp, mercury lamp, metal halide lamp or the like for irradiating ultraviolet rays, electron beam, x-rays, visible light, infrared rays or the like, and in the embodiment ultraviolet rays are employed as the light source.

Figure 2:
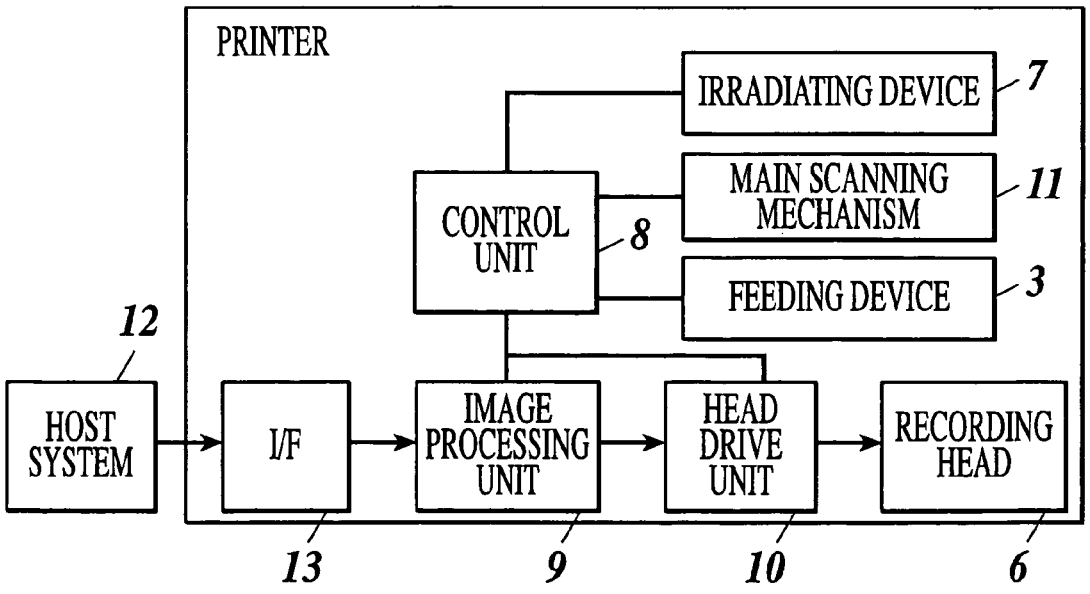
FIG. 2 is a block diagram showing the configuration of the ink jet recording apparatus according to the first embodiment of the invention.

As shown in FIG. 2, the ink jet recording apparatus of the embodiment comprises a control unit 8. The control unit 8 is electrically connected to an image processing unit 9, a head drive unit 10 for driving recording heads 6, a main scanning mechanism 11, feeding devices 3 and the irradiating devices 7, for controlling each of the configuration units or devices.

The image processing unit 9 receives encoded input image data sent from a host system 12 through an interface (I/F) 13, and sends the image data converted to a data format to be processed by the printer 1 to the head drive unit 10. The host system 12 is connected to external apparatuses (not shown) through a network, and the host system 12 or the external apparatus sends to the ink jet recording apparatus 1 image data to be recorded and also executes input process to control overall operation of the printer 1. The host system 12 or the external apparatus can also execute input process for setting a drive frequency to drive the recording heads 6.

Figure 3:
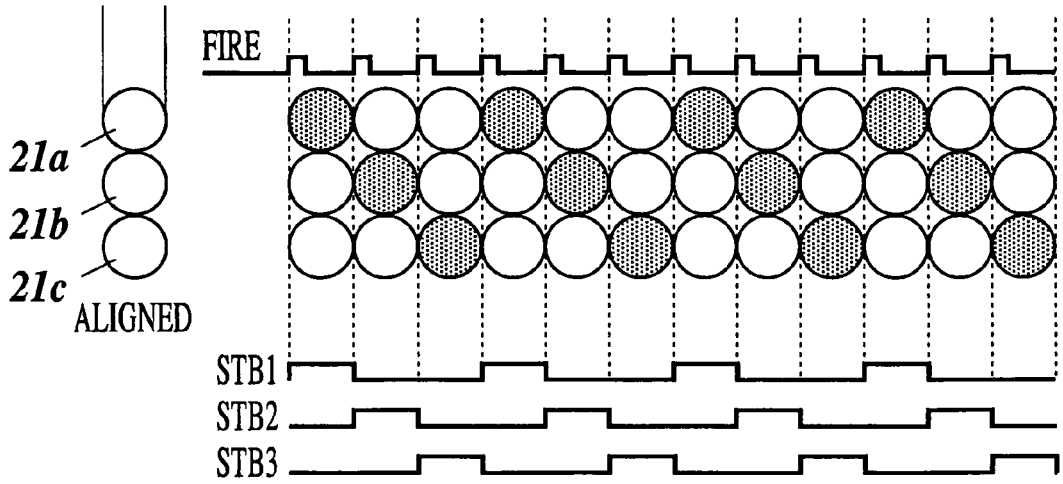
FIG. 3 shows recorded pixels and strobe pulses in the case that nozzles are aligned with three-phase drive and three times of interleaving in the first embodiment.

Each recording head 6 is what is called a serial type head, and has a plurality of nozzles on the ink-jetting surface thereof, being aligned in the sub scanning direction to jet ink onto the recording medium (see FIG. 3).

The head drive unit 10 is controlled to jet inks from the nozzles of the recording heads 6 by applying to piezoelectric elements of the recording heads 6 pulse voltage to record the data relating to the recorded image obtained from the image processing unit 9 based on the signals sent from the control unit 8.

The main scanning mechanism 11 has a drive motor (not shown) for driving the carriage 5, and activation of the drive motor by the control unit 8 causes the carriage 5 to scan along the guide rails in the scanning direction.

The feeding devices 3 comprises feed motors and feed rollers (both not shown) for being periodically and rotatably driven to feed the recording medium P by a unit of predetermined feed amount, and actuation of the feed motors by the control unit 8 allows the medium P to be intermittently fed during image recording.

The irradiating devices 7 cure the ink deposited on the recording medium P by irradiation of ultraviolet rays given from the light sources.

The control unit 8 comprises CPU, ROM and RAM (none of them shown), and processing programs stored in the ROM are developed and stored into the RAM to be executed by the CPU. The control unit 8 controls the main scanning mechanism 11 for reciprocally moving the carriage in the main scanning direction during image recording, and also controls the feeding devices 3 for feeding the medium P in the sub scanning direction. The control unit 8 further sends to the head drive unit 10 command signals, such as the driving frequency set by the host system 12 or the external apparatus, and causes the head drive unit 10 to apply pulse voltages to the respective piezoelectric elements of the recording heads 6 based on given image recording information for jetting ink from the nozzles on the recording heads 6 by a predetermined period.

In the ink jet recording apparatus 1 of the embodiment, the recording heads 6 are controlled with a multi-phase drive by the control unit 8. In a case of 3-phase drive, for example, assuming that three nozzles constitute one group among the nozzles aligned in the sub scanning direction on each head 6, a first nozzle and every third nozzle (spaced by two nozzles between them) aligned in the sub scanning direction, simultaneously jet ink by phase 1 drive, similarly, a second nozzle adjacent to the first nozzle in the sub scanning direction and every third nozzle jet ink by phase 2 drive, and a third nozzle adjacent to the second nozzle in the sub scanning direction and every third nozzle jet ink by phase 3 drive.

The control unit 8 in the embodiment controls ink jetting from the nozzles such that, every time a drive phase is switched, recording starts with recorded pixel locations shifted in the main scanning direction by integer times the pixel width of recording resolution.

FIG. 3 is one example of control by the control unit 8 for ink jetting from nozzles in the embodiment, showing recorded pixels by three nozzles associated with 3-phase drive out of aligned nozzles on the recording head 6. In FIG. 3, a nozzle 21*a* is controlled by the control unit 8 to jet ink in phase 1, a nozzle 21*b* in phase 2, and a nozzle 21*c* in phase 3.

In FIG. 3, ink jetting from nozzles starts at the position shifted in the main scanning direction by one time the pixel width (one pixel) in every phase.

STB 1 indicates a strobe pulse for switching the phase at the nozzle 21*a*, STB 2 at the nozzle 21*b*, and STB 3 at the nozzle 21*c*, and respective phases of the nozzles 21*a*, 21*b* and 21*c* are changed at either timing in the strobe pulse width. This phase switching corresponds to a frequency, and the strobe pulse width corresponds to a period of each phase.

By switching phases of the nozzles 21*a*, 21*b* and 21*c* in this order from the upside of the sub scanning direction for recording a contiguous pixel in the main scanning direction for each phase, time for one pixel can be fully used as the strobe pulse width for each phase. In other words, by controlling ink jetting from nozzles on the head 6 so as to record contiguous pixels in the main scanning direction, each phase period can be made wider relative to a pixel clock.

Further, the control unit 8 controls ink jetting from the nozzles so as to perform three times of interleaving. Here, the interleaving means that a plurality of contiguous pixels in a scanning direction are recorded with plural times of scanning. For example, three times of interleaving means that a plurality of contiguous pixels in the scanning direction are formed with three times of scanning by jetting ink every three pixels (spaced by two pixels) in the scanning direction.

Thus, the nozzles 21*a*, 21*b* and 21*c* in the 3-phase drive are controlled to start recording while moving by one pixel in the main scanning direction, and to perform three times of interleaving. Resultantly, the first scanning records pixels on a slant as shown in FIG. 3, the second scanning records each pixel next to the previous pixel by one pixel, and a third scanning completes record of all pixels.

Regarding recorded pixels thus recorded with ink jetting from the nozzles under the control of the control unit 8, a recorded pixel location X, which indicates where a specific recorded pixel is located from a reference position in the main scanning direction when an arbitrary pixel as the reference position is set to 1, and the number of carriage scanning S necessary for completing record, are given by following expressions, respectively:

$$X=\{(i-1)\times f+P-1\}\times D+1 \quad (1)$$

and $$S=f\times D\times R_p/R_n \quad (2)$$

or $$S=f\times D\times P_n/P_p \quad (3)$$

where i is the number of a pixel when counted from the reference position out of pixels recorded by one same nozzle in the main scanning direction, D is the shifted number of pixels in the main scanning direction at every phase of recorded pixels, f is the number of head-drive phases, P is a drive phase number (a phase number allotted from P=1 to P=f in the order of drive, designating the drive phase to record the reference position pixel as P=1), S is the number of passes in the multi-pass recording, $R_n$ is resolution on a head in the sub scanning direction, $R_p$ is recording resolution in the sub scanning direction, $P_n$ is a mean pitch between adjacent nozzles in the sub scanning direction, and $P_p$ is a recorded pixel pitch in the sub scanning direction.

Figure 6:
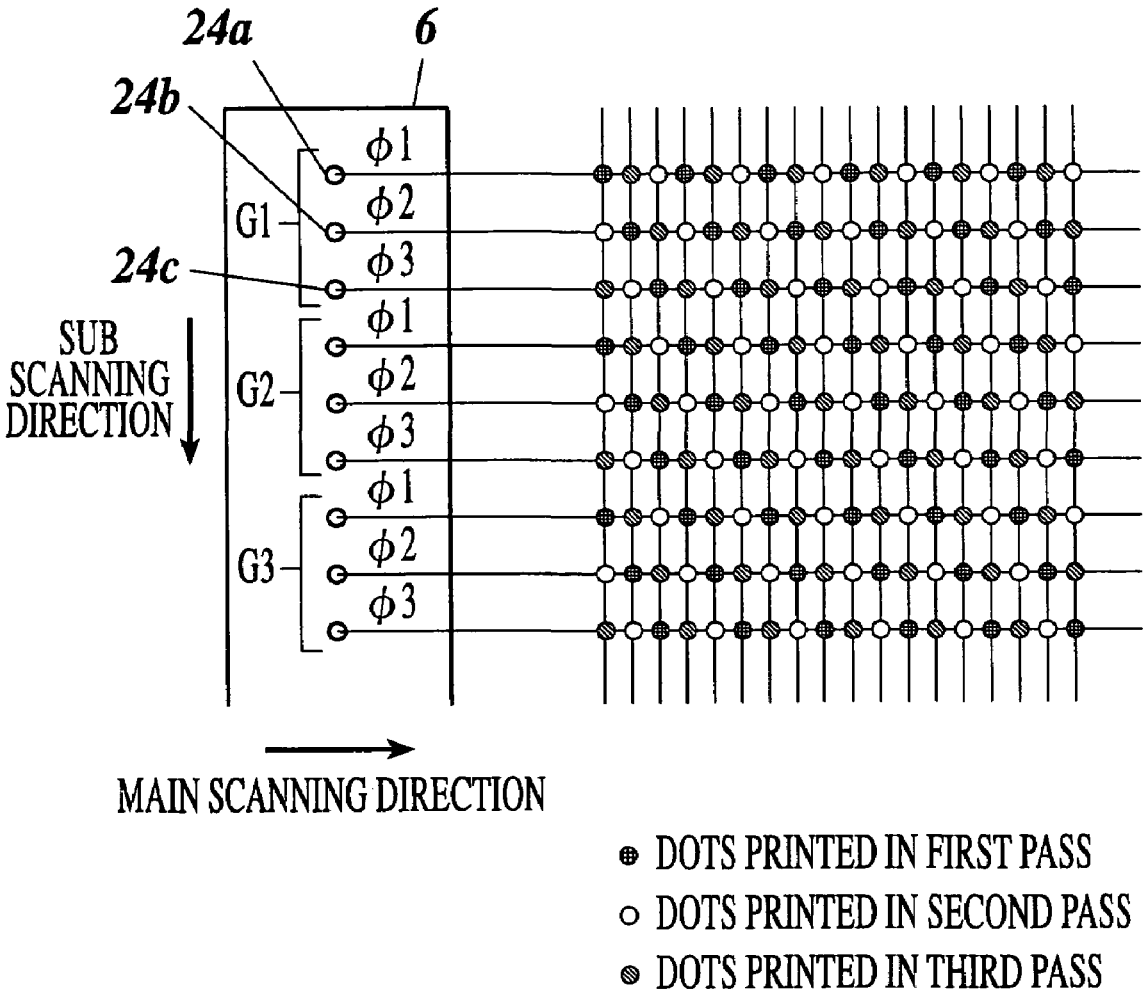
FIG. 6 shows recorded pixels recorded by a recording method using aligned nozzles in the first embodiment.

FIG. 6 is one example of recording method under the conditions that the head 6 has 256 nozzles in the sub scanning direction, nozzle resolution is 360 dpi, nozzle pitch is 70.56 μm, and recording resolution is 360 dpi in both directions of main scanning and sub scanning, showing recorded pixel locations recorded under the similar conditions to those of FIG. 3, that is, the head 6 is driven with three-phase drive and three times of interleaving, and each phase starts jetting ink at the position where the head is shifted by integer times the pixel width of recording resolution, that is, by one time pixel-width (by one pixel) in the main scanning direction.

Referring to FIG. 6, assuming that a recorded pixel at left and uppermost end is defined as a reference position, the pixel location X, for example, recorded at a second position (i=2) out of pixels recorded in a first scanning, is obtained by substituting in the expression (1) by i=2, f=3, P=1 and D=1, and results in X=4. That is, the pixel recorded at a second position in the first scanning is a $4^{th}$ pixel counted from the reference position pixel in the main scanning direction.

Figure 4:
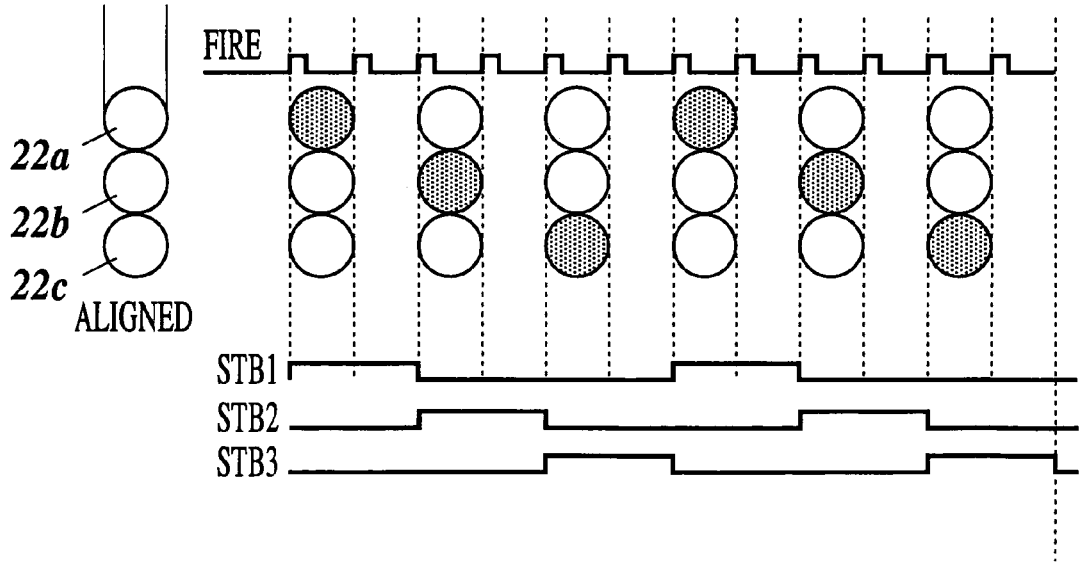
FIG. 4 shows recorded pixels and strobe pulses in the case that nozzles are aligned with three-phase drive, two pixels of displacement and six times of interleaving in the first embodiment.

As shown in FIG. 4, in the case that the control unit 8 controls such that the displacement amount of recorded pixels between the phases is double the pixel-width (two-pixel width) in the main scanning direction, the expression (1) can be also applied, by setting two kinds of reference positions. That is, the expression (1) is met for the pixels aligned with one pixel spaced in the scanning direction in the case of two-pixel displacement. Similarly, for recorded pixels with n-pixel displacement, the expression (1) can also be applied, by setting n kinds of reference positions.

With regard to the number of scanning S, applying the expression (2) with substitution by f=3, D=1, $R_p$=360 dpi and $R_n$=360 dpi, S=3 is obtained, therefore it is understood that all pixels can be recorded by three times of scanning. In FIG. 6, the pitch between recorded pixels in the sub scanning direction $P_p$ is 25400 μm/360 dpi=70.56 μm, and the mean pitch between adjacent nozzles in the sub scanning direction $P_n$ is also 25400 μm/360 dpi=70.56 μm, therefore $P_n/P_p$=1. Accordingly, substituting in the expression (3) by f=3, D=1 and $P_n/P_p$=1, S=3 is also obtained, which means that three times of scanning can complete recording of all pixels.

Figure 7:
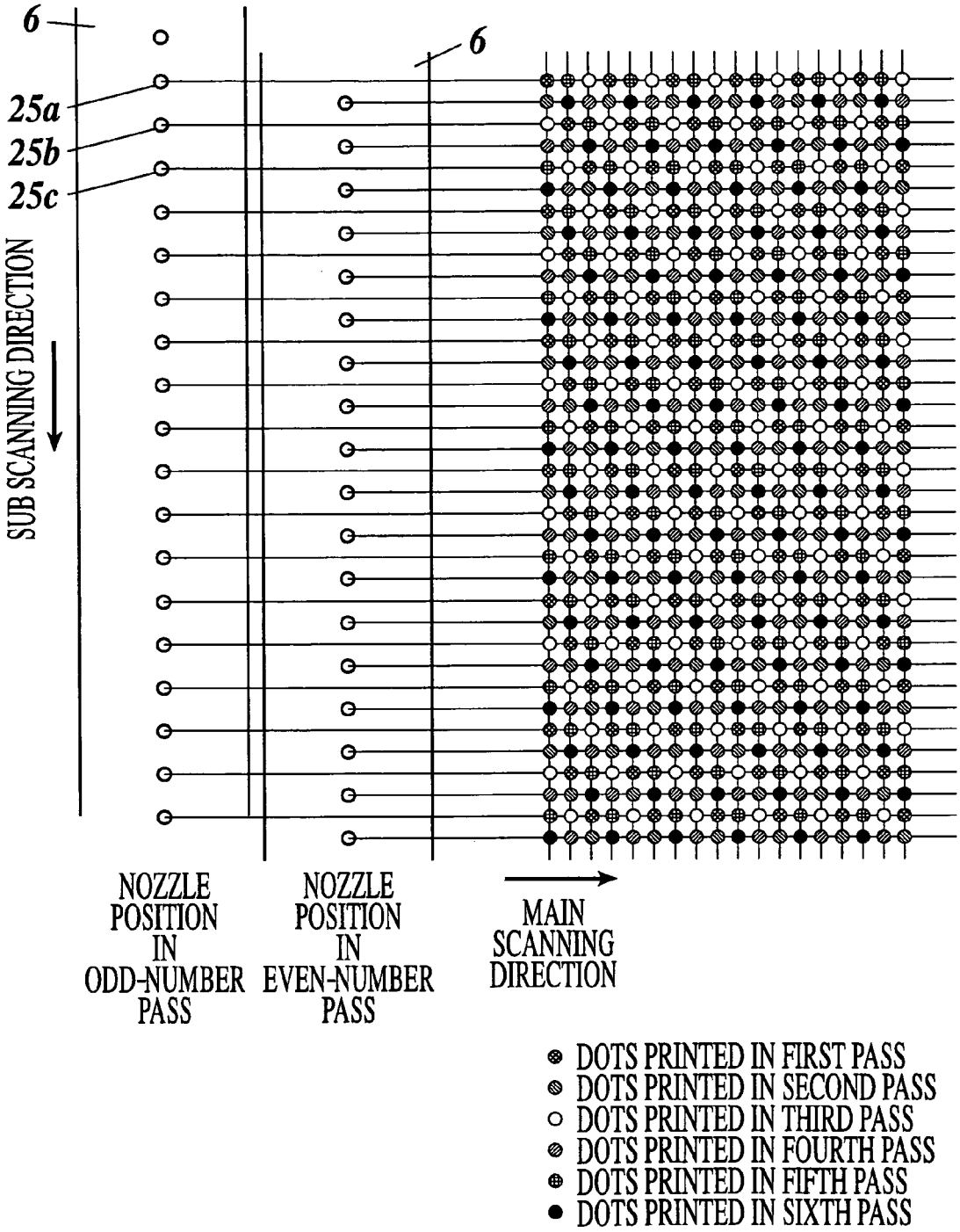
FIG. 7 shows recorded pixels recorded by a recording method using aligned nozzles with doubled pixel resolution in a sub scanning direction, and six times of interleaving in the first embodiment.

FIG. 7 is one example of recording method under the conditions that the head 6 has 256 nozzles in the sub scanning direction, nozzle resolution is 360 dpi, nozzle pitch is 70.56 μm, and recording resolution is 720 dpi in both directions of main scanning and sub scanning, showing recorded pixel locations recorded under the conditions that the head 6 is driven with three-phase drive and three times of interleaving, and each phase starts jetting ink at the position where the head is shifted by one time pixel-width (by one pixel) in the main scanning direction In this embodiment, the recorded pixel location X from the reference position can be also obtained by using the expression (1). Assuming that a recorded pixel at left and uppermost end is defined as the reference position, the pixel location X, for example, recorded at a second position (i=2) out of pixels recorded in a first scanning, is obtained by substituting in the expression (1) by i=2, f=3, P=1 and D=1, resulting in X=4. That is, the pixel recorded at the second position in the first scanning is a $4^{th}$ pixel counted from the pixel of reference position in the main scanning direction.

As to the number of scanning S, since the recording resolution in the sub scanning direction in FIG. 7 is twice of that in FIG. 6, applying the expression (2) with substitution by f=3, D=1, $R_p$=720 dpi and $R_n$=360 dpi, S=6 is obtained, therefore it is understood that all pixels can be recorded by six times of scanning. In FIG. 7, the pitch between recorded pixels in the sub scanning direction $P_p$ is ½ of $P_n$, therefore $P_n/P_p=2$. Accordingly, substituting in the expression (3) by f=3, D=1 and $P_n/P_p=2$, S=6 is also obtained, which means that six times of scanning can complete recording of all pixels.

FIG. 4 is another example of the embodiment showing the control of ink jetting from nozzles by the control unit 8. A nozzle 22*a* is controlled by the control unit 8 to jet ink in phase 1, a nozzle 22*b* in phase 2, and a nozzle 22*c* in phase 3. Ink jetting from the nozzle starts at the position shifted in the main scanning direction by double of the pixel width (by two pixels) in every phase.

Further, the control unit 8 controls ink jetting from the nozzles so as to perform six times of interleaving. Here, six times of interleaving means that a plurality of contiguous pixels in the scanning direction are formed with six times of scanning by jetting ink every six pixels (spaced by five pixels) in the scanning direction.

In FIG. 4, STB 1 indicates a strobe pulse for switching the phase at the nozzle 22*a*, STB 2 at the nozzle 22*b*, and STB 3 at the nozzle 22*c*. Thus, by switching phases of the nozzles 22*a*, 22*b* and 22*c* in this order from the upper side of the sub scanning direction for recording a pixel with one pixel spaced in the main scanning direction in each phase, two-pixel times can be fully used for each strobe pulse width. Resultantly, the strobe pulse width or each phase period can be made wider relative to a pixel clock.

Figure 5:
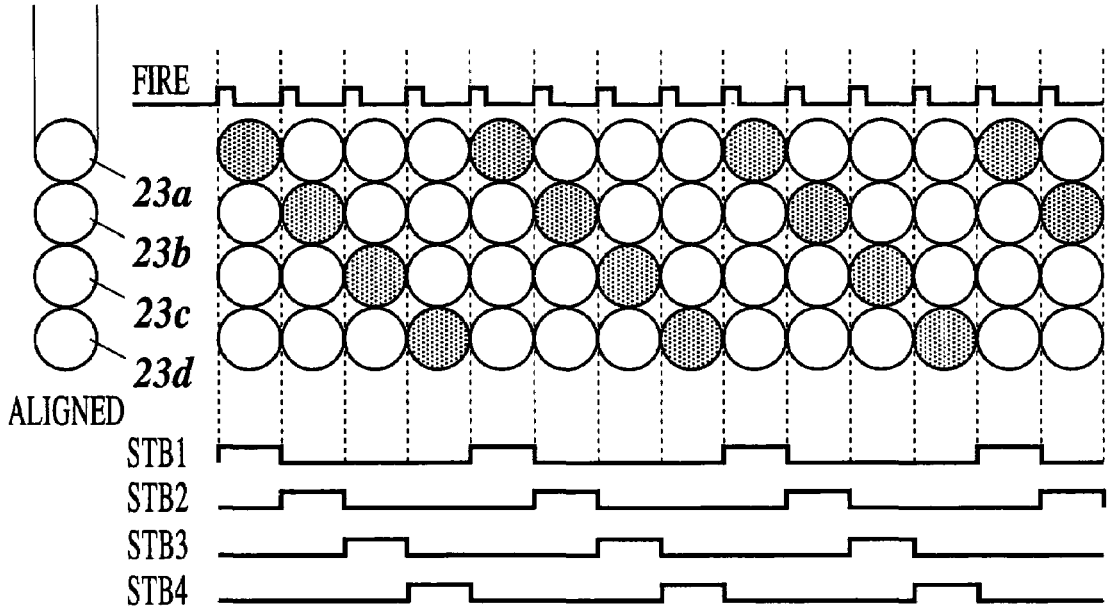
FIG. 5 shows recorded pixels and strobe pulses in the case that nozzles are aligned with four-phase drive and four times of interleaving in the first embodiment.

FIG. 5 is another example of the embodiment showing the control of ink jetting from nozzles by the control unit 8. A nozzle 23*a* is controlled by the control unit 8 to jet ink in phase 1, a nozzle 23*b* in phase 2, a nozzle 23*c* in phase 3, and a nozzle 23*d* in phase 4. Ink jetting from the nozzle starts at the position shifted in the main scanning direction by one time the pixel-width (by one pixel) in every phase.

Further, the control unit 8 controls ink jetting from the nozzles so as to perform four times of interleaving. Here, four times of interleaving means that a plurality of contiguous pixels in the scanning direction are formed with four times of scanning by jetting ink every four pixels (spaced by three pixels) in the scanning direction.

In FIG. 5, STB 1 indicates a strobe pulse for switching the phase at the nozzle 23*a*, STB 2 at the nozzle 23*b*, STB 3 at the nozzle 23*c*, and STB 4 at the nozzle 23*d*. Thus, by switching phases of the nozzles 23*a*, 23*b*, 23*c* and 23*d* in this order from the upside of the sub scanning direction for recording a contiguous pixel in the main scanning direction for each phase, time for one pixel can be fully used as the strobe pulse width for each phase, similarly to the case in FIG. 3. Resultantly, the strobe pulse width or each phase period can be made longer relative to a pixel clock.

A description will now be given of an ink jet recording method according to the invention using the ink jet recording apparatus 1 described above. The description below assumes for convenience that entire pixels are recorded on the recording medium P.

FIG. 6 is an example in the case that the number of nozzles and the number of pixels in the sub scanning direction are both 256.

Initially, when the control unit 8 receives predetermined image recording information from the host system 12 or the external apparatus, the control unit 8 moves the recording heads 6 up to a record starting position on the recording medium P.

Upon starting record, in the first scanning of the head 6, a nozzle 24*a* driven in phase 1 records pixels on a first row in the main scanning direction every three pixels (spaced by two pixels), a nozzle 24*b* driven in phase 2 on a second row, and a nozzle 24*c* driven in phase 3 on a third row. That is, recording starts from the position shifted by one pixel in the main scanning direction for each phase. Repetition of such process causes respective phase of nozzles to record pixels on the slant. Then, the feeding devices 3 feed the recording medium P in the sub scanning direction by 85-pixel length. Thereafter, by a second scanning, pixels are recorded on respective phase of rows, each pixel being contiguous to the recorded pixel of the first scanning in the main scanning direction. Next, the feeding devices 3 again feed the recording medium P in the sub scanning direction by 85-pixel length, and the heads 6 records residual pixels in a third scanning. With these three times of scanning, entire pixels are recorded.

During the image recording on the recording medium, the irradiating devices 7 irradiate ultraviolet rays on the ink deposited on the medium P to cure the ink.

Meanwhile, if the medium P is fed by 85-pixel length after head scanning, while the number of pixels in the sub scanning direction is 256, one nozzle for one pixel line remains unused in case of three times of scanning. Therefore, the nozzle at the upper end or lower end in the sub scanning direction is inhibited from jetting ink in one scanning of the three times of scanning.

FIG. 7 shows an example of recorded pixels, which includes 256 nozzles and 512 pixels in the sub scanning direction, that is, the recorded resolution in the sub scanning direction is double of the resolution of the head. Regarding a recording method for this example, different points from the case described above will be explained.

Referring to FIG. 7, when recording starts, in the first scanning of the head 6, a nozzle 25*a* driven in phase 1 records pixels on a first row in the main scanning direction every three pixels (spaced by two pixels), a nozzle 25*b* driven in phase 2 records pixels on a third row in the main scanning direction every three pixels, each pixel being contiguous to the recorded pixel in phase 1 in the main scanning direction, and a nozzle 25*c* driven in phase 3 records pixels on a fifth row in the main scanning direction every three pixels, each pixel being contiguous to the recorded pixel in phase 2 in the main scanning direction. With this recording method, recorded pixels in the first scanning are deposited on every other row on the slant in the main scanning direction. Then, the feeding devices 3 feed the recording medium P in the sub scanning direction by 85-pixel length. Thereafter, by a second scanning, pixels are recorded on respective phase of rows, each pixel being contiguous to the recorded pixel of the first scanning in the main scanning direction. Next, the feeding devices 3 again feed the recording medium P in the sub scanning direction by 85-pixel length. Then, by a third scanning, pixels are recorded on respective phase of rows, each pixel being contiguous to the recorded pixel of the second scanning in the main scanning direction. Repeating these processes, entire pixels are recorded by six times of scanning.

In the embodiment, if the medium P is fed by 85-pixel length after head scanning, while the number of pixels in the sub scanning direction is 512, one nozzle for one pixel row remains unused in case of three times of scanning. Therefore, the nozzle at the upper end and/or lower end in the sub scanning direction is inhibited from jetting ink in one or plural times of scanning of the six times of scanning.

According to the ink jet recording apparatus 1 and the ink jet recording method in the embodiment described above, nozzles, aligned in the sub scanning direction on the recording head 6 to be driven with multi-phase drive, record pixels by jetting of ink with the recorded pixel locations shifted by integer times recording-resolution in the main scanning direction at every drive-phase switching. With this structure, it is not necessary to switch each phase within one-pixel time, and therefore carriage speed does not depend on a staggered pitch, allowing each phase of period for driving the recording head 6 to be longer. Further, even if nozzles on the head 6 are arranged in high density, high quality images can be obtained with improved productivity, by applying multi-phase drive and plural times of scanning of the head with the recorded pixel locations shifted in the main scanning direction at every drive-phase switching.

In other words, according to the ink jet recording apparatus 1 and the ink jet recording method in the embodiment, since the one-pixel time can be fully used for switching a phase, carriage speed does not depend on a staggered pitch, which differs from a conventional method, but on a pixel pitch. The staggered pitch is usually about ten micron, and given by (pixel pitch in a main scanning direction/the number of drive phases). Accordingly, if the pixel pitch in the scanning direction is one inch (25400 μm)/720 dpi, and the number of phases is three, then the staggered pitch is 11.759 μm. In a conventional ink jet recording apparatus, carriage speed has depended on this staggered pitch. To the contrary, a pixel pitch is one inch (25400 μm)/720 dpi=35.278 μm. Thus, the pixel pitch is three times longer than the staggered pitch, and therefore the upper limit of carriage speed is permitted three times higher than conventional one, if the ink jet recording apparatus according to the embodiment is used with its recording method.

In the ink jet recording apparatus 1 and the ink jet recording method according to the embodiment, recorded pixel location X is represented by the expression (1), and the number of carriage scanning S by the expressions (2) or (3).

b. Second Embodiment

A second embodiment of the invention will now be explained with reference to FIGS. 8 to 12.

An ink jet recording apparatus 1 in the embodiment is a serial type ink jet recording apparatus, and similar to the first embodiment comprises a platen 2, feeding devices 3, guide rails 4, and a carriage 5 having recording heads 6 and irradiating devices 7 mounted thereon.

However, each recording head 6 of the embodiment has staggered nozzles arranged thereon. A staggered pitch is the value of a recorded pixel pitch divided by the number of drive phases. In the embodiment, the recorded pixel pitch is one inch (25400 μm)/720 dpi, and the number of drive phases is three, therefore the staggered pitch is 11.759 μm.

As shown in FIG. 2, the ink jet recording apparatus 1 comprises a control unit 8. The control unit 8 is electrically connected to an image processing unit 9, a head drive unit 10 for driving recording heads, a main scanning mechanism 11, and feeding devices 3, for controlling each of the configuration units or devices. This configuration is also similar to that of the first embodiment.

Further, as in the first embodiment, the recording heads 6 of the embodiment is controlled with multi-phase drive, and the control unit 8 controls ink jetting from the nozzles such that, every time drive phases are switched, recording starts with a recorded pixel location shifted in the main scanning direction by integer times the pixel width of recording resolution.

Figure 8:
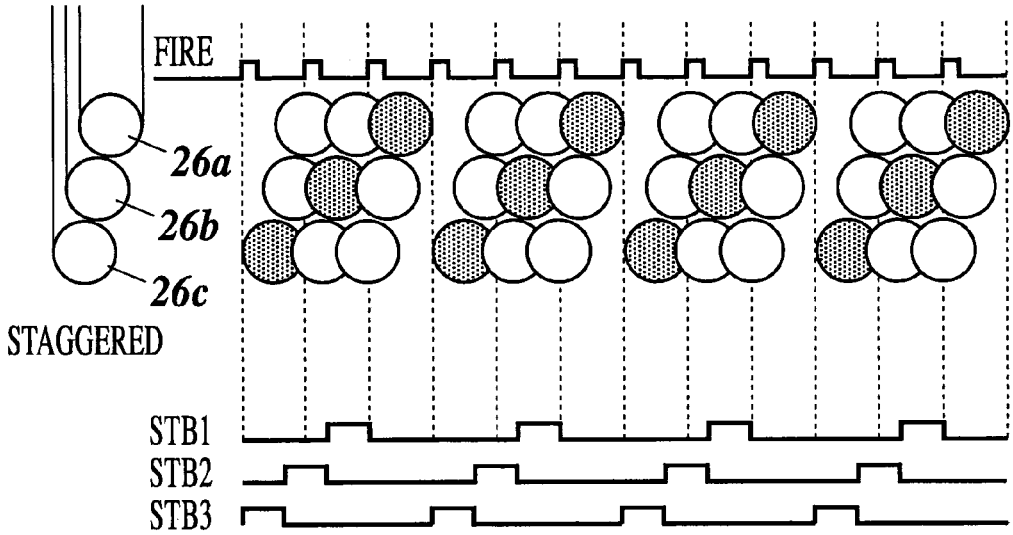
FIG. 8 shows recorded pixels and strobe pulses in the case that nozzles are staggered with three-phase drive and three times of interleaving in a second embodiment.

FIG. 8 is one example of ink jetting control by the control unit 8, showing pixels recorded by three nozzles driven with 3-phase drive out of staggered nozzles on the recording head 6. In FIG. 8, a nozzle 26*c* is controlled by the control unit 8 to jet ink in phase 1, a nozzle 26*b* in phase 2, and a nozzle 26*a* in phase 3. That is, nozzles on the head 6 are controlled so as to be driven from the nozzle 26*c*, which is arranged at the downstream side in the main scanning direction, to the nozzle 26*b* and the nozzle 26*a* in this order for every phase switching.

Further, the nozzles 26*a*, 26*b* and 26*c* are controlled to start recording with 3-phase drive while shifted by one time pixel-width (by one pixel) in the main scanning direction at every phase switching, and to perform three times of interleaving. As a result, the first scanning records pixels on a slant as shown in FIG. 8, the second scanning records pixels next to the previous pixels by one pixel, and the third scanning completes recording of all pixels.

Since the embodiment is the same as the first embodiment except that the nozzles on the head 6 are staggered, recorded pixel location X and the number of carriage scanning S are also calculated by the expressions (1) to (3).

Figure 12:
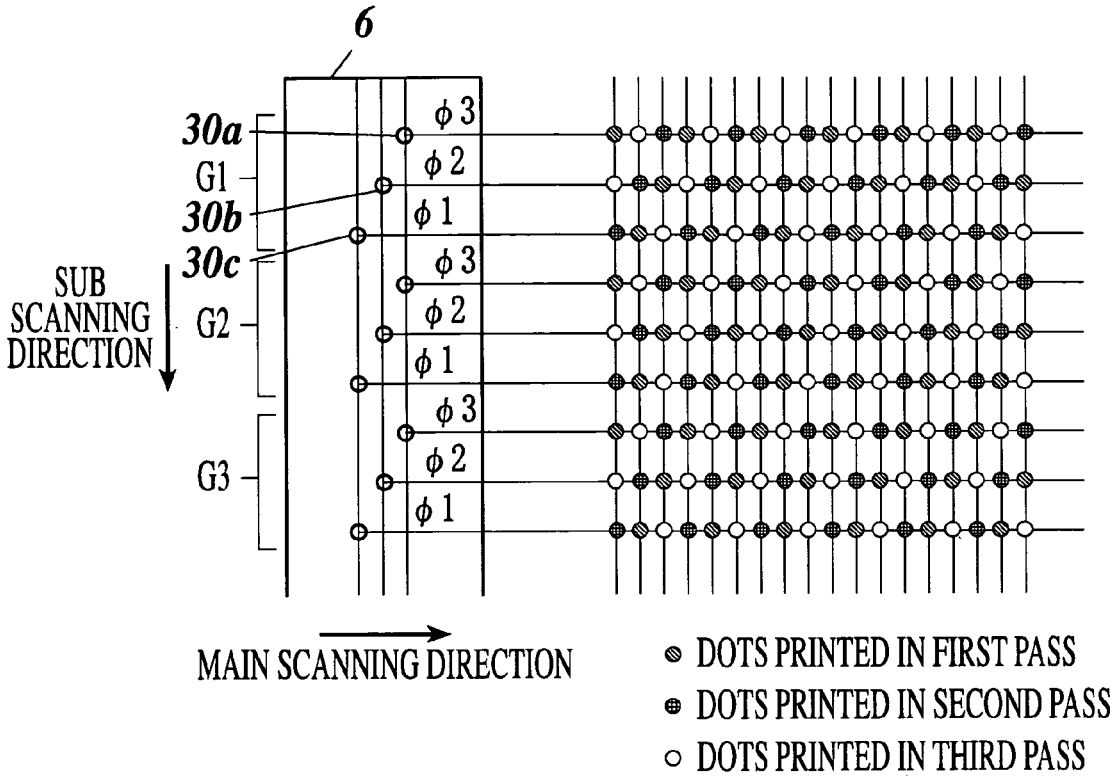
FIG. 12 shows recorded pixels recorded by a recording method using staggered nozzles in the second embodiment.

FIG. 12 shows, as in FIG. 8, pixel locations recorded by jetting ink from the staggered nozzles on the head 6 under conditions that the head 6 is driven with 3-phase drive and three times of interleaving with the head starting record at the position shifted by one time the pixel-width (one pixel) in the main scanning direction at every phase switching.

In FIG. 12, assuming that a recorded pixel at left and uppermost end is defined as a reference position, the pixel location X, for example, recorded at a second position (i=2) out of pixels recorded in a first scanning, is obtained by substituting in the expression (1) by i=2, f=3, P=1 and D=1, and results in X=4. That is, the pixel recorded at the second position in the first scanning is a $4^{th}$ pixel counted from the reference position pixel in the main scanning direction. This is the same result as calculated in FIG. 6 of the first embodiment. Regarding the number of scanning S, substituting in the expression (2) by f=3, D=1, $R_p$=360 dpi and $R_n$=360 dpi, S=3 is obtained, and substituting in the expression (3) by f=3, D=1, and $P_n/P_p$=1, S=3 is obtained. This is also the same as in the first embodiment.

In FIG. 8, STB 1 indicates a strobe pulse for switching the phase at the nozzle 26*a*, STB 2 at the nozzle 26*b*, and STB 3 at the nozzle 26*c*. Thus, by switching phases of the nozzles 26*c*, 26*b* and 26*a* in this order from the downstream side in the main scanning direction for recorded pixels contiguous to each other in the main scanning direction in each phase, drive phases are switched three times within two-pixel time. The reason for 3-times switching within 2-pixel time is: each nozzle for phase 2 and phase 3 reaches its target position earlier than the previous-phase nozzle by a staggered pitch in the main scanning direction, and therefore each switching has to be set relatively in a shorter time. When drive phase is changed from phase-3 to phase-1, nozzle drive is suspended for one pixel time, because phase-1 nozzle reaches relatively later by the staggered pitch.

Accordingly, if the strobe pulse width, i.e., switching period for each phase is given by T, clock period for recorded pixels (the time for the head to move by a recorded pixel pitch) by T', and the number of drive phases by f, then $$T=T'\times\{(D-1)+(f-1)/f\} \quad (4)$$

In FIG. 8, f=3 for 3-phase drive, and D=1 for 1 pixel displacement, then T=⅔×T'. That is, the phase switching is performed by ⅔ of the time of pixel clock period.

Figure 28:
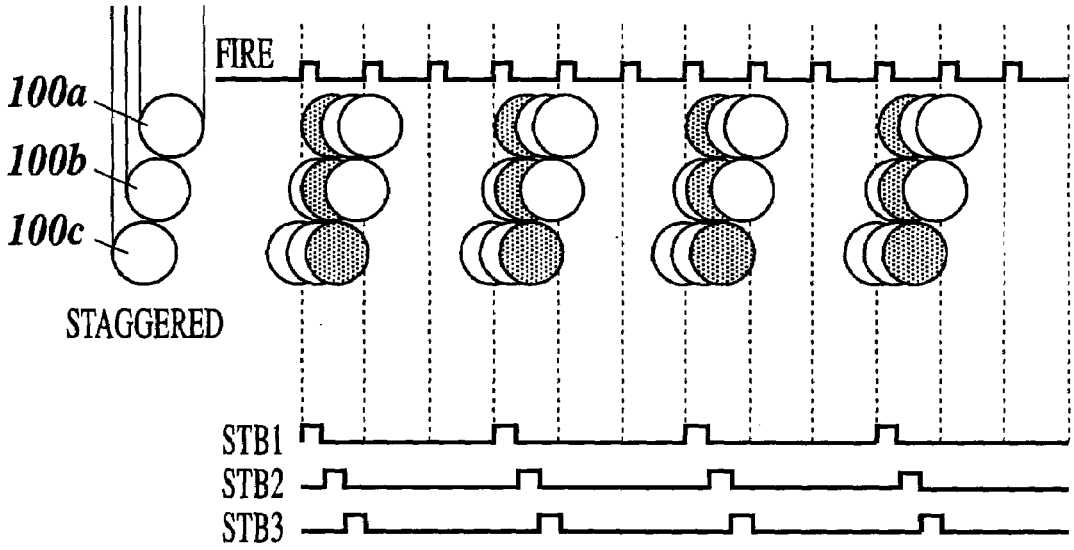
FIG. 28 shows recorded pixels and strobe pulses in the case that nozzles are staggered with three-phase drive and three times of interleaving in an earlier developed apparatus.
Figure 29:
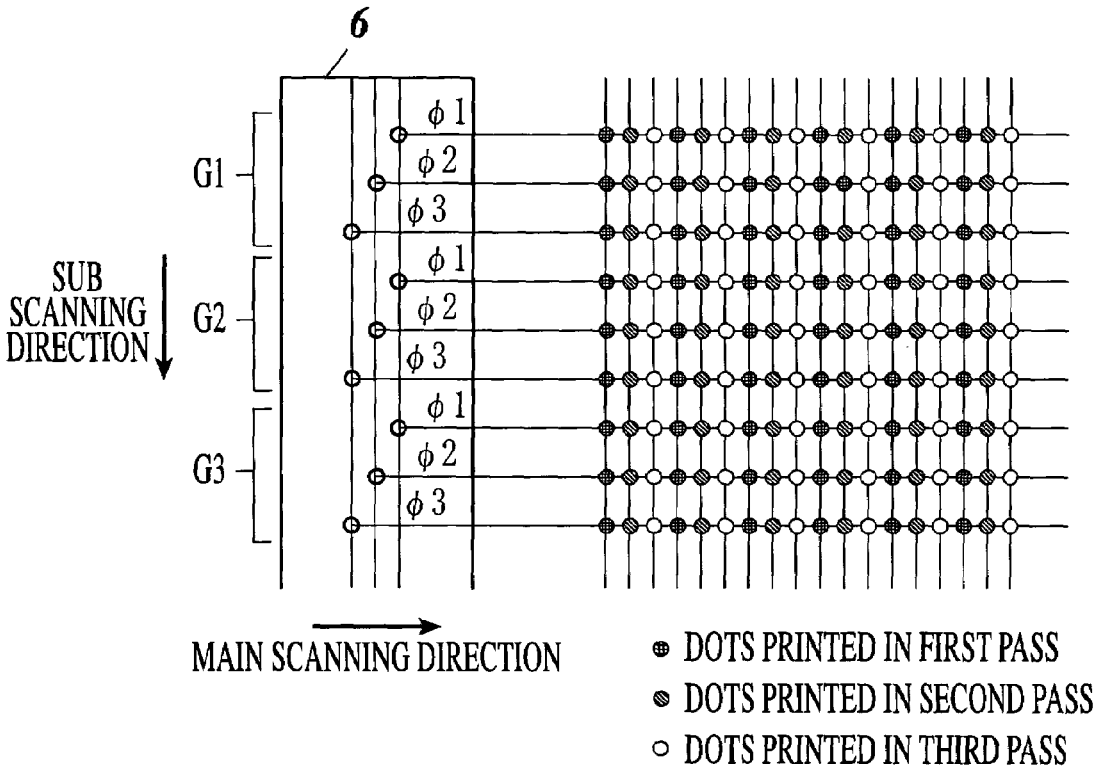
FIG. 29 shows recorded pixels recorded by a recording method using earlier developed staggered nozzles.

According to such a recording method, because three times of switching is performed within 2-pixel time, a strobe pulse width can be made wider relative to the pixel clock, compared with a conventional recording method in which three times of switching is performed within 1-pixel time as shown in FIG. 28. That is, each phase switching period can be made longer in the embodiment.

Figure 9:
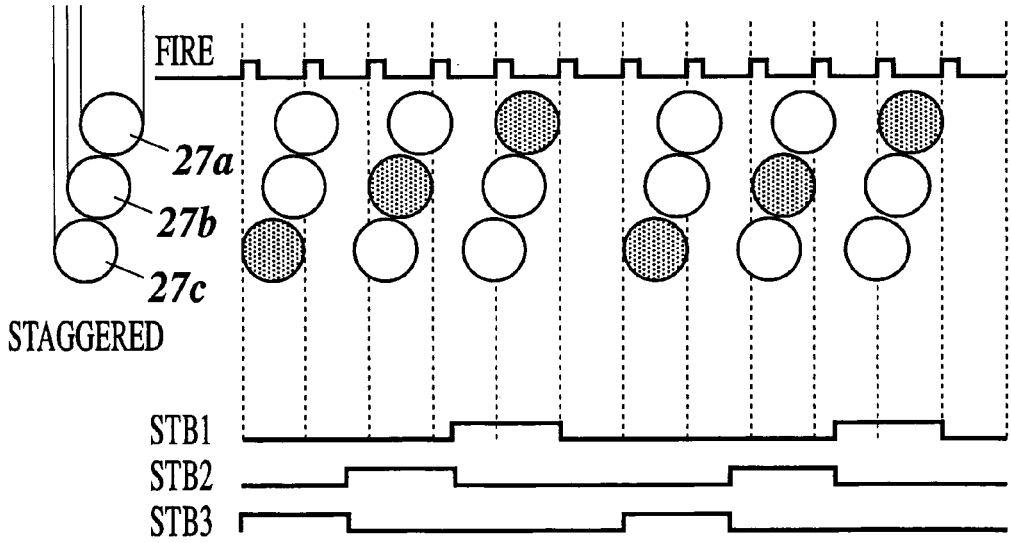
FIG. 9 shows recorded pixels and strobe pulses in the case that nozzles are staggered with three-phase drive, two pixels of displacement and six times of interleaving in the second embodiment.

FIG. 9 is another example of the embodiment showing the control of ink jetting from nozzles with 3-phase drive by the control unit 8. A nozzle 27*c* is controlled by the control unit 8 to jet ink in phase 1, a nozzle 27*b* in phase 2, and a nozzle 27*a* in phase 3. The ink jetting from the nozzle starts at the position shifted in the main scanning direction by double the pixel width (by two pixels) in every phase, and six times of interleaving fills all pixels by recording a plurality of contiguous pixels in the scanning direction with six times of scanning.

In FIG. 9, STB 1 indicates a strobe pulse for switching the phase at the nozzle 27*a*, STB 2 at the nozzle 27*b*, and STB 3 at the nozzle 27*c*. Thus, by switching phases of the nozzles 27*c*, 27*b* and 27*a* in this order from the downstream side in the main scanning direction for recording a pixel by every 2 pixels in the main scanning direction in each phase, drive phases are switched three times within 5-pixel time. The reason of 3-times switching within 5-pixel time is: each nozzle for phase 2 and phase 3 reaches its target position earlier than the previous phase nozzle by a staggered pitch in the main scanning direction, and therefore each switching has to be set relatively in a shorter time. When drive phase is changed from phase-3 to phase-1, nozzle drive is suspended for 1-pixel time, because phase-1 nozzle reaches relatively later by the staggered pitch.

In this example, the expression (4) is also applicable for calculating the phase switching period for each phase T. For FIG. 9, f=3 for 3-phase drive, and D=2 for 2-pixel displacement are given, then T=(1+⅔)×T'. That is, the phase switching is performed by ⅚ of the time of pixel clock period.

According to this recording method, because three times of switching is performed within 5-pixel time, a strobe pulse width can be made relatively wider with respect to the pixel clock, compared with a conventional recording method in which three times of switching is performed within 1-pixel time as shown in FIG. 28. Therefore, each phase switching period can be made longer in the embodiment.

Figure 10:
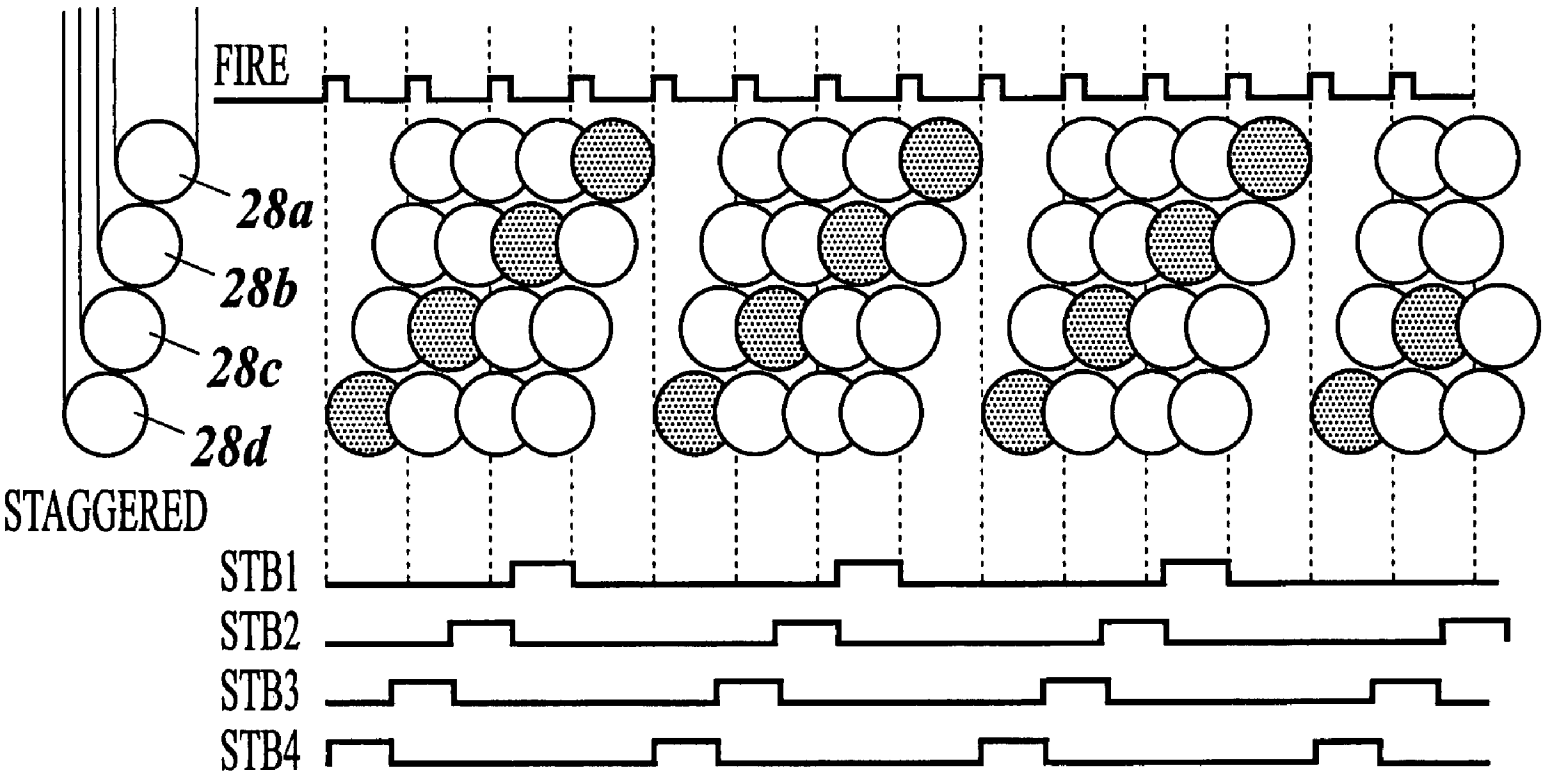
FIG. 10 shows recorded pixels and strobe pulses in the case that nozzles are staggered with four-phase drive and four times of interleaving in the second embodiment.

FIG. 10 is still another example of the embodiment showing the control of ink jetting from nozzles by the control unit 8. A nozzle 28*d* is controlled by the control unit 8 to jet ink in phase 1, a nozzle 28*c* in phase 2, a nozzle 28*b* in phase 3, and a nozzle 28*a* in phase 4. The ink jetting from the nozzle starts at the position shifted in the main scanning direction by one time pixel width (by one pixel) in every phase, and four times of interleaving fills all pixels by recording a plurality of contiguous pixels in the scanning direction with four times of scanning.

In FIG. 10, STB 1 indicates a strobe pulse for switching phase at the nozzle 28*a*, STB 2 at the nozzle 28*b*, STB 3 at the nozzle 28*c*, and STB 4 at the nozzle 28*d*. Thus, by switching phases of the nozzles 28*d*, 28*c*, 28*b* and 28*a* in this order from the downstream side in the main scanning direction for recording a contiguous pixel to each other in the main scanning direction in each phase, drive phases are switched 4 times within 3-pixel time. The reason of 4-times switching within 3-pixel time is: each nozzle for phase 2, phase 3 and phase 4 reaches its target position earlier than the previous phase nozzle by a staggered pitch in the main scanning direction, and therefore each switching has to be set relatively in a shorter time. When drive phase is changed from phase-4 to phase-1, nozzle drive is suspended for 1-pixel time, because phase-1 nozzle reaches relatively later by the staggered pitch.

In this example, the expression (4) is also applicable for calculating the phase switching period T. For FIG. 10, f=4 for 4-phase drive, and D=1 for 1-pixel displacement are given, then T=¾×T'. That is, the phase switching is performed by ¾ of the time of pixel clock period.

According to this recording method, because four times of switching is performed within 3-pixel time, a strobe pulse width can be made relatively wider with respect to the pixel clock, compared with a conventional recording method in which three times of switching is performed within 1-pixel time as shown in FIG. 28. Therefore, each phase switching period can be made longer in the embodiment.

Figure 11:
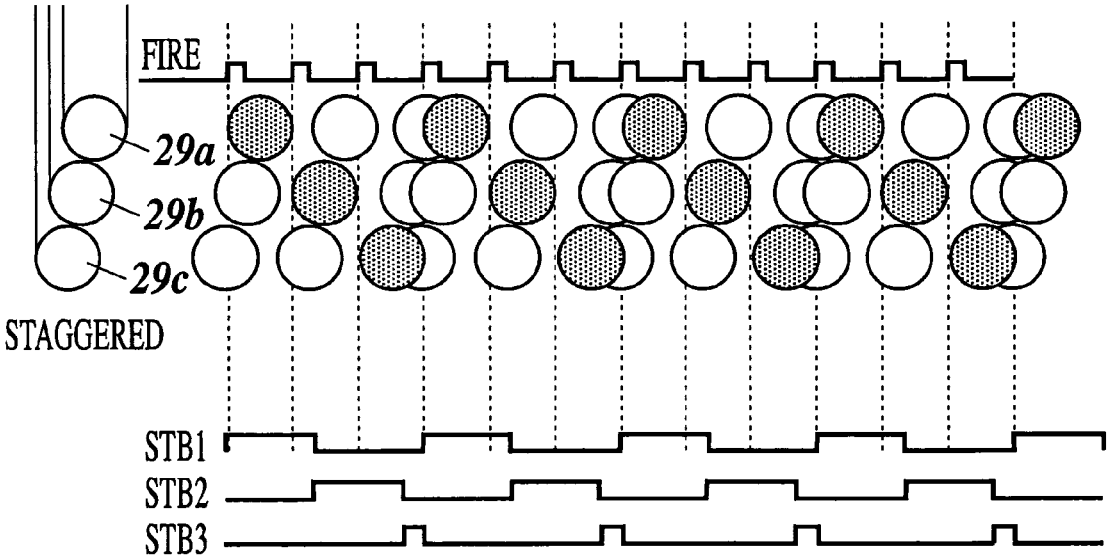
FIG. 11 shows recorded pixels and strobe pulses in the case that nozzles are staggered with three-phase drive in reverse phase order and three times of interleaving in the second embodiment.

In the case that nozzles are staggered on the recording head 6, if ink jetting would be performed sequentially from the upstream side nozzle in the main scanning direction as shown in FIG. 11, nozzles 29*b* and 29*c* take longer time by a staggered pitch in the main scanning direction after the recording by nozzle 29*a*, and their strobe pulse width become wider relative to the pixel clock. Further, because the nozzle 29*a* moves in advance of the nozzle 29*c* by a staggered pitch, when the nozzle 29*a* records again after recording by the nozzle 29*c*, its strobe pulse should be switched abruptly with high frequency so as to be in time for recording. For avoiding this abrupt switching, ink jetting in the embodiment is performed from the downstream side nozzle in the main scanning direction to secure relatively wider strobe pulse width.

A description will now be given of an ink jet recording method according to the invention in the points different from the first embodiment, using the ink jet recording apparatus 1 described above. The description below assumes for convenience that entire pixels are recorded on the recording medium P.

Referring to FIG. 12, when recording starts, in a first scanning of the head 6, the nozzle 30*c* driven in phase 1 records pixels on a third row in the main scanning direction every three pixels (spaced by two pixels), similarly, a nozzle 30*b* driven in phase 2 on a second row, and a nozzle 30*a* driven in phase 3 on a first row. That is, each phase of nozzle starts recording at the position shifted by one pixel in the main scanning direction. Repetition of such process causes respective phase of the nozzles to record pixels on the slant. Then, the feeding devices 3 feed the recording medium P in the sub scanning direction by 85-pixel length. Thereafter, by a second scanning, pixels are recorded on respective phase of rows, each pixel being contiguous to the recorded pixel of the first scanning in the main scanning direction. Next, the feeding devices 3 again feed the recording medium P in the sub scanning direction by 85-pixel length, and the heads 6 records residual pixels in a third scanning. With these three times of scanning, entire pixels are recorded.

In the embodiment, three times of scanning also make one nozzle for one pixel line left unused. Therefore, the nozzle at the upper end or lower end in the sub scanning direction is inhibited from jetting ink in one scanning of the three times of scanning.

According to the ink jet recording apparatus 1 and the ink jet recording method in the embodiment described above, carriage speed does not depend on a staggered pitch, as in the first embodiment, allowing each phase of period for driving the recording head 6 to be longer.

A recorded pixel location X is also represented by the expression (1), and the number of carriage scanning S by the expressions (2) or (3).

Further, the phase switching period for each phase T is given by the expression (4), because the head 6 has staggered nozzles mounted thereon in the embodiment.

Additionally, since the staggered nozzles in the embodiment are driven from the nozzle at the downstream side in the main scanning direction, abrupt switching for each phase is not needed to be in time for recording. Therefore each phase of period can take longer time, resulting in higher carriage speed.

An actual pitch in the case of staggered arrangement is given by a difference between the pixel pitch and the staggered pitch, that is, 35.278-11.759=23.519 μm. This is two times the staggered pitch, and therefore the recording method according to the invention can achieve two times higher upper limit of carriage speed than conventional one. Similarly, if the drive phase is four or five, the actual pitch becomes three or four times the staggered pitch, respectively, that is, the upper limit of carriage speed can be attained by (the number of drive phases minus one) times the conventional one.

In the embodiment described above, recording is performed by one way carriage scanning in the main scanning direction, but when the carriage scans to a reverse direction in bidirectional recording, the same effect as those described above can be achieved by switching the drive phases in a reverse order.

c. Third Embodiment

A third embodiment of the invention will now be explained with reference to FIGS. 13 to 20.

An ink jet recording apparatus 1 in the embodiment is a serial type ink jet recording apparatus, and similar to the first embodiment in that the printer 1 comprises a platen 2, feeding devices 3, guide rails 4, and a carriage 5 having recording heads 6 and irradiating devices 7 mounted thereon.

However, in the embodiment, each recording head 6 comprises nozzle columns of multiples of the number of drive phases, which comprises nozzles jetting the same kind of ink. The nozzles are arranged in a straight line for each column. A description will be given below of a case in which three columns of the aligned nozzles are used with 3-phase drive.

Figure 13:
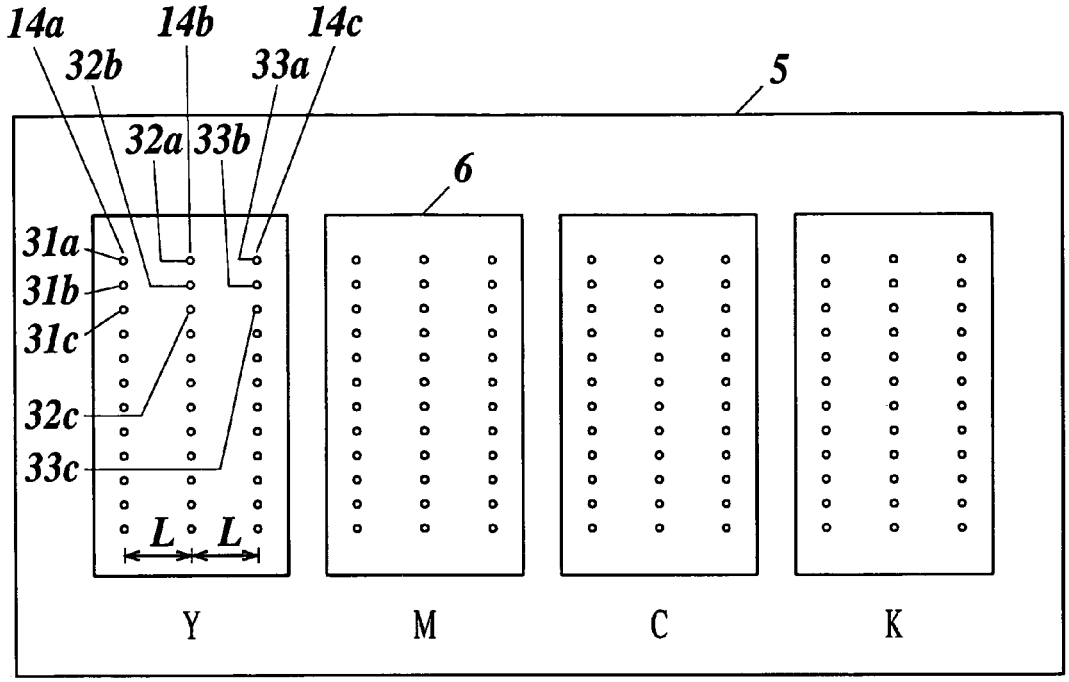
FIG. 13 shows recording heads, each head having three columns of aligned nozzles according to a third embodiment.

In order to provide three nozzle columns, each nozzle jetting the same kind of ink, as shown in FIG. 13, for example, one recording head 6 has three nozzle columns 14*a*, 14*b* and 14*c* formed thereon for jetting the same color ink, and each color of the recording heads 6 is mounted on the carriage 5.

Figure 14:
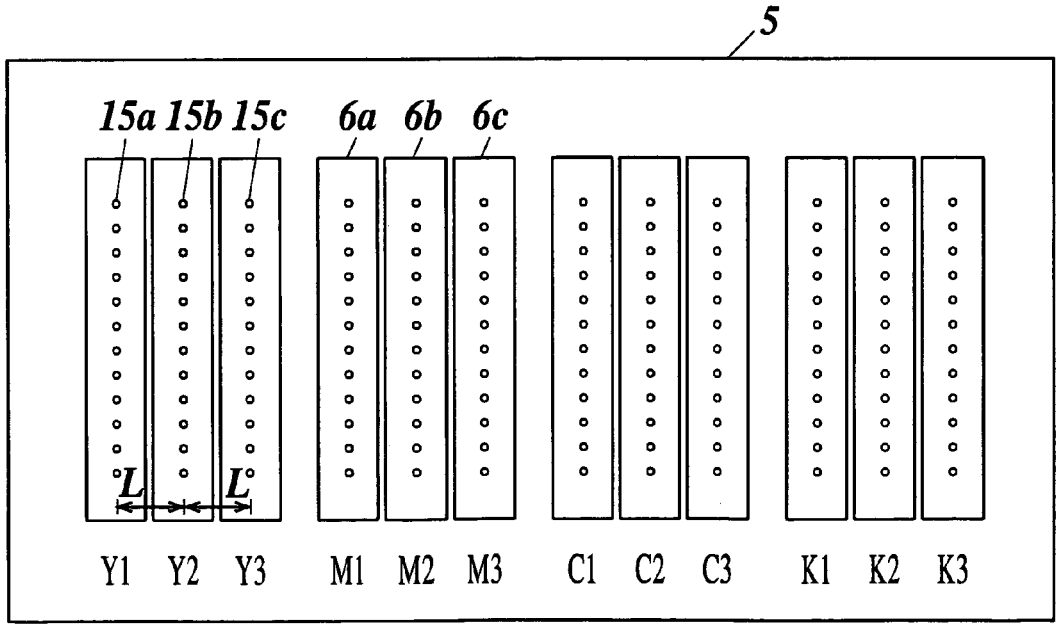
FIG. 14 shows three recording heads, each head having one column of aligned nozzles in the third embodiment.

As shown in FIG. 14, the carriage 5 can have three recording heads 6*a*, 6*b* and 6*c* for jetting the same color ink, three heads 6*a*, 6*b* and 6*c* having nozzle columns 15*a*, 15*b* and 15*c* formed thereon, respectively. An explanation will be given below of the case that the recording head 6 shown in FIG. 13 is used as a typical example.

Each nozzle of the nozzle columns 14*a*, 14*b* and 14*c* is positioned on a straight line extending in the main scanning direction. A distance L between the nozzle columns in the embodiment is set to (a pixel pitch in the main scanning direction) multiplied by (n multiplied by the number of drive phases plus 1), where n is a natural number.

In the embodiment, the pixel pitch in the main scanning direction is one inch (25400 μm)/720 dpi, and the number of drive phases is three, and n=1, therefore (n multiplied by the number of drive phases plus 1)=4, and resultantly the distance L=141.11 μm. If n=3, then (n multiplied by the number of drive phases plus 1)=10, and the distance L=352.78 μm.

As shown in FIG. 2, the ink jet recording apparatus 1 comprises a control unit 8. The control unit 8 is electrically connected to an image processing unit 9, a head drive unit 10 for driving recording heads 6, a main scanning mechanism 11, feeding devices 3 and the irradiating devices 7, for controlling each of the configuration units or devices, which is also the same as that of the first embodiment.

Further, as in the first embodiment, the recording head 6 of the embodiment is controlled with multi-phase drive, and the control unit 8 controls ink jetting from the nozzles such that, every time drive phases are switched, recording starts with a recorded pixel location shifted in the main scanning direction by integer times the pixel width of recording resolution.

However, in the embodiment, ink droplets jetted from nozzles on different nozzle columns do not strike the same recorded pixel location on the recording medium, but strike different recording positions on the recording medium. Especially, nozzles on different nozzle columns and on a same position line in the main scanning direction record on different recorded pixel locations in the main scanning direction from each other in respective drive phases.

The ink jetting from the nozzles on one nozzle column is controlled by the control unit 8 in the same manner as shown in FIG. 3 or the like of the first embodiment. In FIG. 13, a nozzle 31*a* on the nozzle column 14*a*, a nozzle 32*a* on the nozzle column 14*b* and a nozzle 33*a* on the nozzle column 14*c* are controlled to simultaneously jet ink in phase 1, and similarly, nozzles 31*b*, 32*b* and 33*b* in phase 2 and nozzles 31*c*, 32*c* and 33*c* in phase 3.

In this embodiment, as the control of the ink jetting from the nozzles by the control unit 8 shown in FIG. 3, the ink jetting is controlled to start at the position shifted in the main scanning direction by one time the pixel width (one pixel) in every phase, which is same as in the first embodiment.

That is, in this embodiment, STB 1 shown in FIG. 3 indicates a strobe pulse for switching the phase at the nozzles 31*a*, 32*a* and 33*a*, STB 2 at the nozzles 31*b*, 32*b* and 33*b*, and STB 3 at the nozzles 31*c*, 32*c* and 33*c*. Respective phases of the nozzles 31*a* to 33*c* are changed at either timing in the strobe pulse width. This phase switching corresponds to a frequency, and the strobe pulse width corresponds to a period of each phase.

A description will now be given of an ink jet recording method according to the invention, using the ink jet recording apparatus 1 of the embodiment. The description below assumes for convenience that entire pixels are recorded on the recording medium P as in the first embodiment.

Initially, when the control unit 8 receives predetermined image recording information from the host system 12 or the external apparatus, the control unit 8 determines a recorded pixel location at each drive phase switching so that the recorded pixel location can be shifted by integer times the pixel width of recording resolution in the main scanning direction (every one time the pixel width in the embodiment as described above), and moves the recording head 6 up to a record starting position on the recording medium P.

Subsequently, the control unit 8 makes the recording head 6 scan in the main scanning direction with the drive phase of the recording head 6 switched as shown in FIG. 3, to jet ink from the nozzles 31*a* through 33*c* of the recording head 6, thereby recording on different recorded pixel locations from one another by the ink jetting from the nozzles on different nozzle columns 14*a*, 14*b* and 14*c* of the recording head 6.

Figure 15A:
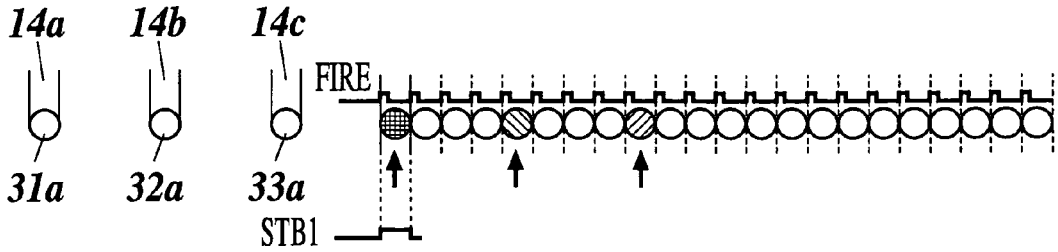
FIGS. 15A to 15D show a state of recording on a recording medium by three nozzles aligned in a main scanning direction in the third embodiment.

Regarding to the nozzle 31*a* of the nozzle column 14*a*, the nozzle 32*a* of the nozzle column 14*b*, and the nozzle 33*a* of the nozzle column 14*c*, as the distance L between the nozzle columns, in the case that n=1, that is, the distance between the nozzle columns has three times the pixel pitch in the main scanning direction, when the drive phase is switched by the strobe pulse STB 1, the three nozzles jet ink on three recorded pixel locations as indicated by arrows in FIG. 15A.

Figure 15B:
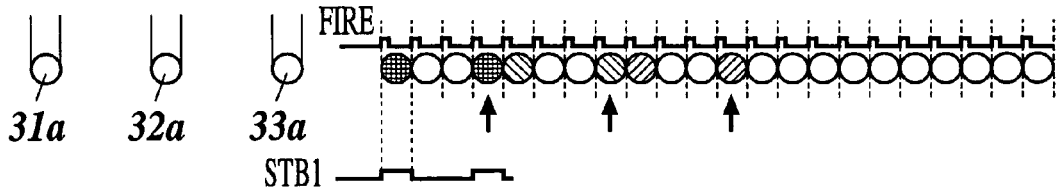
Figure 15C:
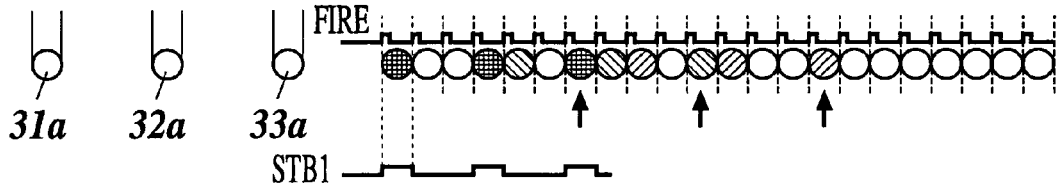
Figure 15D:
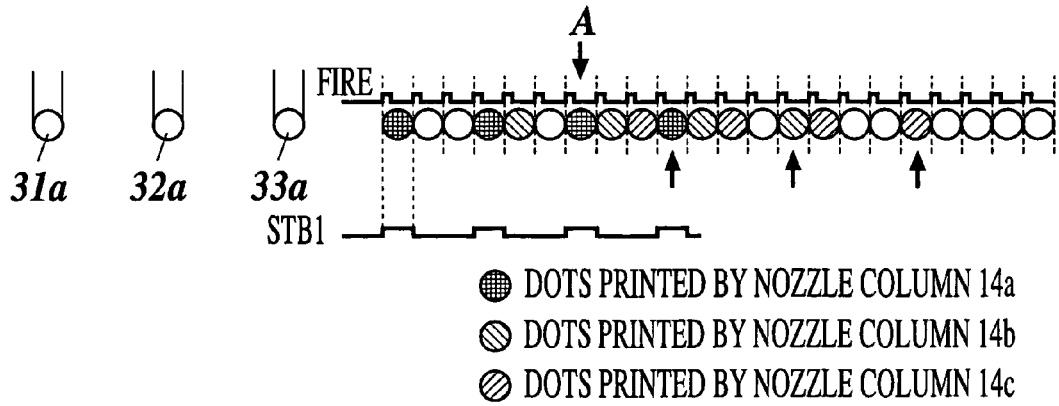

Subsequent phase switching causes the three nozzles to record additional three pixel locations as indicated by arrows in FIG. 15B, and further phase switching by the strobe pulses to record further three pixel locations as indicated by arrows in FIGS. 15C and 15D, respectively.

Figure 16:
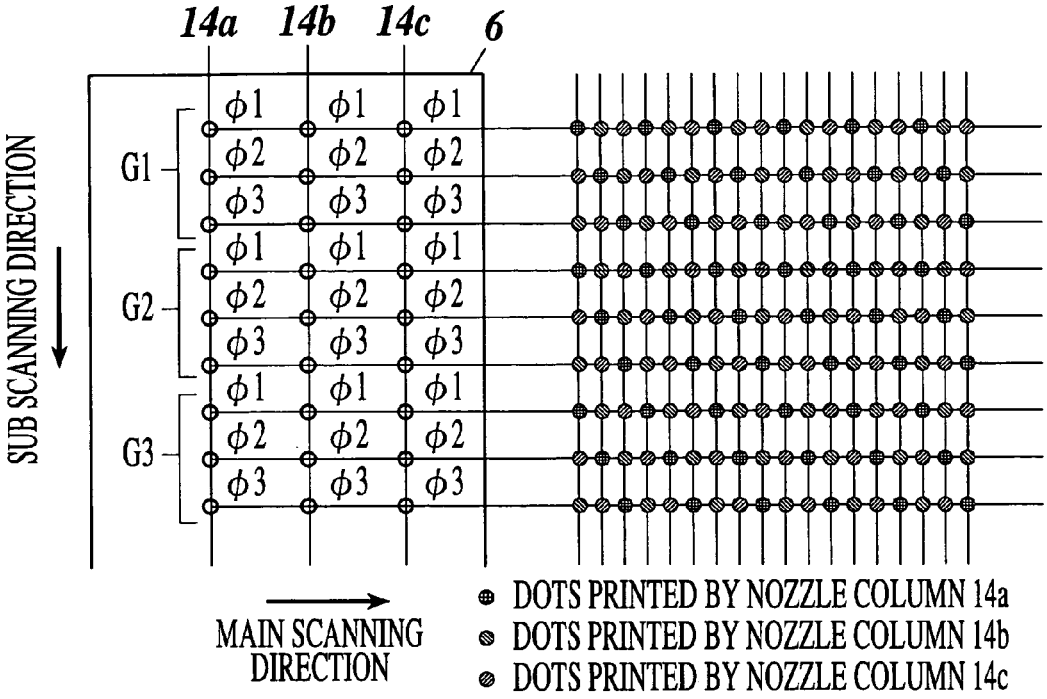
FIG. 16 shows recorded pixels recorded by a recording method using three columns of aligned nozzles on the recording head in the third embodiment.
Figure 17:
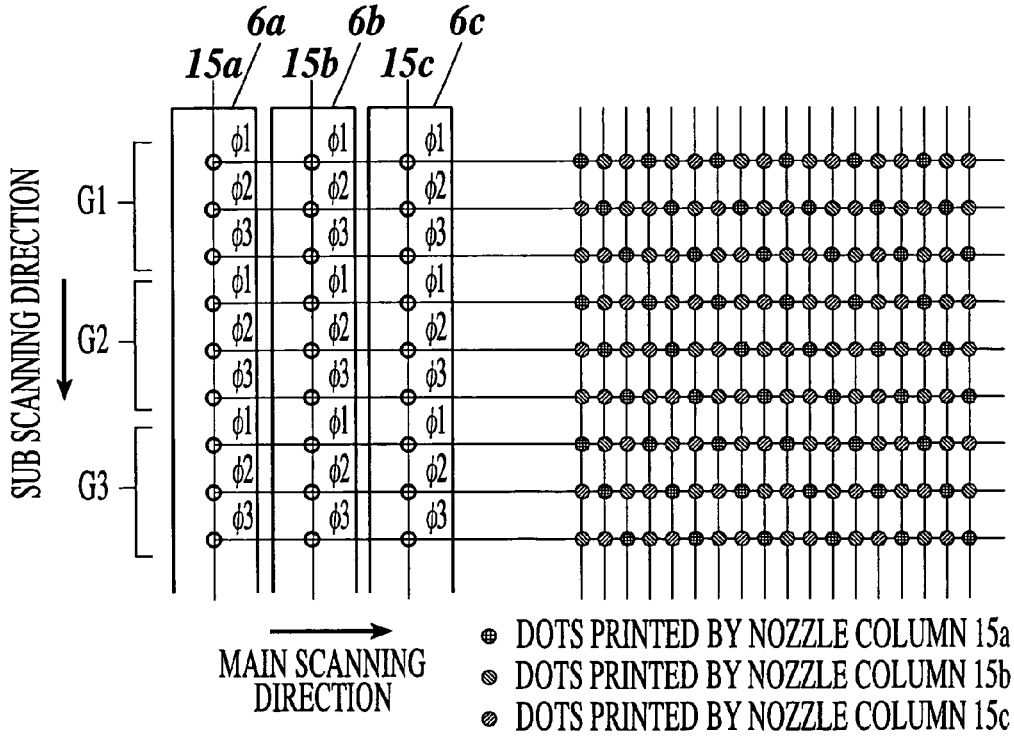
FIG. 17 shows recorded pixels recorded by a recording method using three recording heads, each having one column of nozzles in the third embodiment.

With such recording, all recorded pixel locations succeeding to a pixel location A shown in FIG. 15D are recorded by nozzles on any one of nozzle columns 14*a*-14*c*. If this recording process is applied to all nozzles on each nozzle column, the same result as of FIG. 6 in the first embodiment can be obtained as shown in FIG. 16. In the case that recording heads 6*a*, 6*b* and 6*c* have respective nozzle columns 15*a*, 15*b* and 15*c* formed thereon as shown in FIG. 14, all recorded pixel locations could be recorded in the similar manner as shown in FIG. 17.

According to the ink jet recording apparatus 1 and its recording method in the embodiment, all pixels, covered with the recording width of the head 6 in the sub scanning direction, can be recorded by one time scanning of the head 6 in the main scanning direction, which differs from the first and second embodiments. This will be understood from FIGS. 15A-15D, FIG. 16 or FIG. 17.

In the embodiment, instead of the recording method that all pixels are recorded by one time scanning of the head 6 as shown in FIGS. 15A-15D, it would be also possible to record all pixels by plural times of head scanning, for instance, such that a first scanning records half of all pixels, and the next scanning records the rest of pixels.

As described above, according to the printer 1 and its recording method of the embodiment, control method by the control unit 8 is the same as in the first embodiment, and therefore the same effects as in the first embodiment can be achieved. That is, carriage speed does not depend on a staggered pitch, and therefore each phase of period for driving the recording head 6 can be made longer. Further, high quality images can be obtained with improved productivity, by applying multi-phase drive and the recording with recorded pixel locations shifted in the main scanning direction at every drive phase switching, even if nozzles on the head 6 are arranged in high density.

When one image is recorded by multiple scanning as in the first embodiment, there are sometimes found displacement in the main scanning direction due to reciprocating scanning of the head 6, slanting movement of the medium P, misalignment of head assembling, or the like, which is possible to cause fluctuation in a vertical direction (sub scanning direction) in the image recorded on the medium P, that is, distortion in right-and-left direction on inherently straight lines. To the contrary, it is possible, in the embodiment, to record all pixels covered with the recording width of the head 6 in the sub scanning direction by one time scanning of the head 6 in the main scanning direction. This recording by one time scanning can effectively suppress fluctuation in the image, thereby obtaining high quality images with improved productivity.

Figure 18:
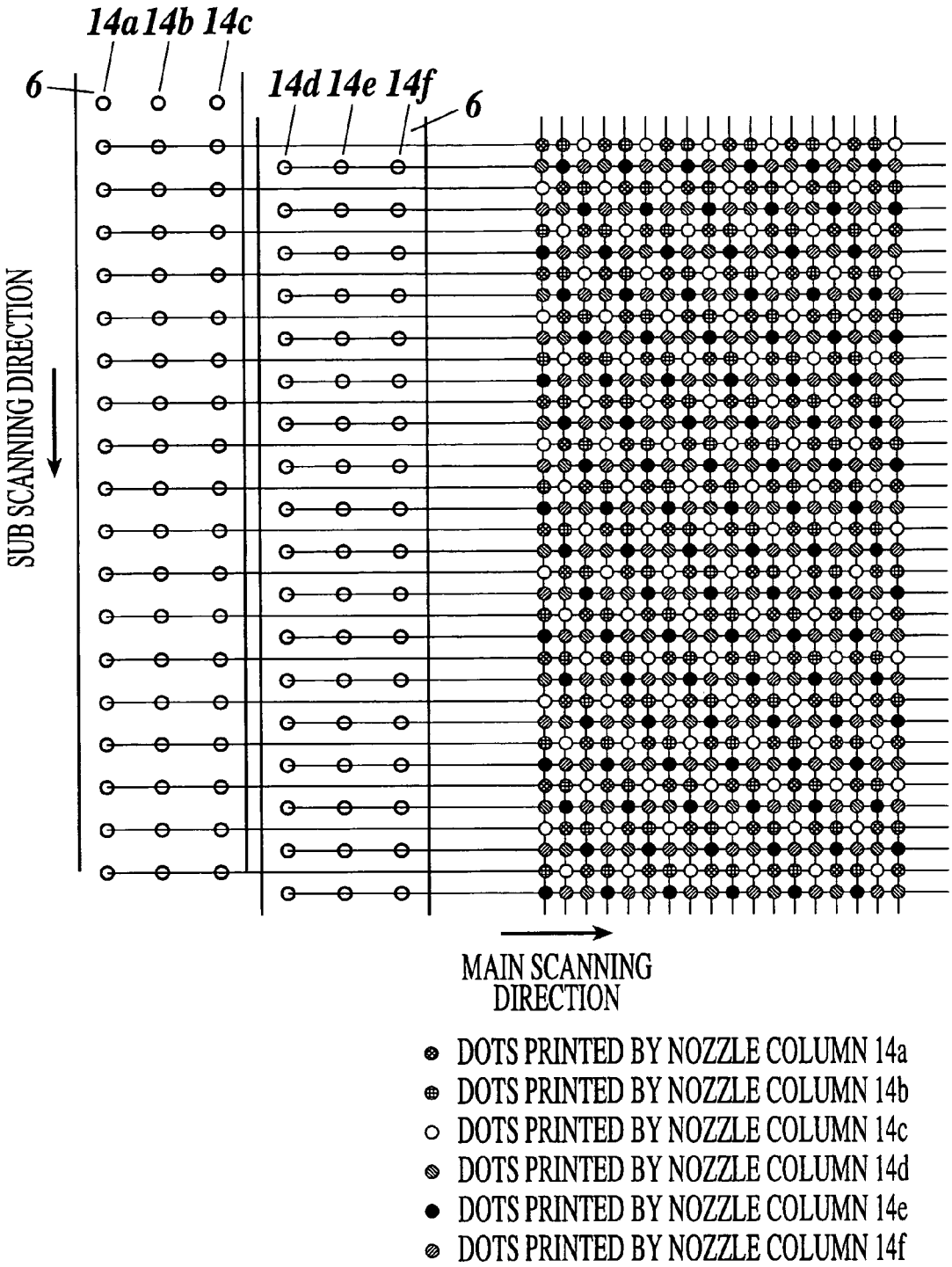
FIG. 18 shows recorded pixels recorded by a recording method using six columns of nozzles in the third embodiment.

Referring to FIG. 18, the recording heads could have double the nozzle columns with 3-phase drive, for example, six nozzle columns 14*a* to 14*f* for jetting ink. While six times scanning is needed in the first embodiment for recording one image, this arrangement can record it by one time scanning, allowing more effective image recording.

Figure 19:
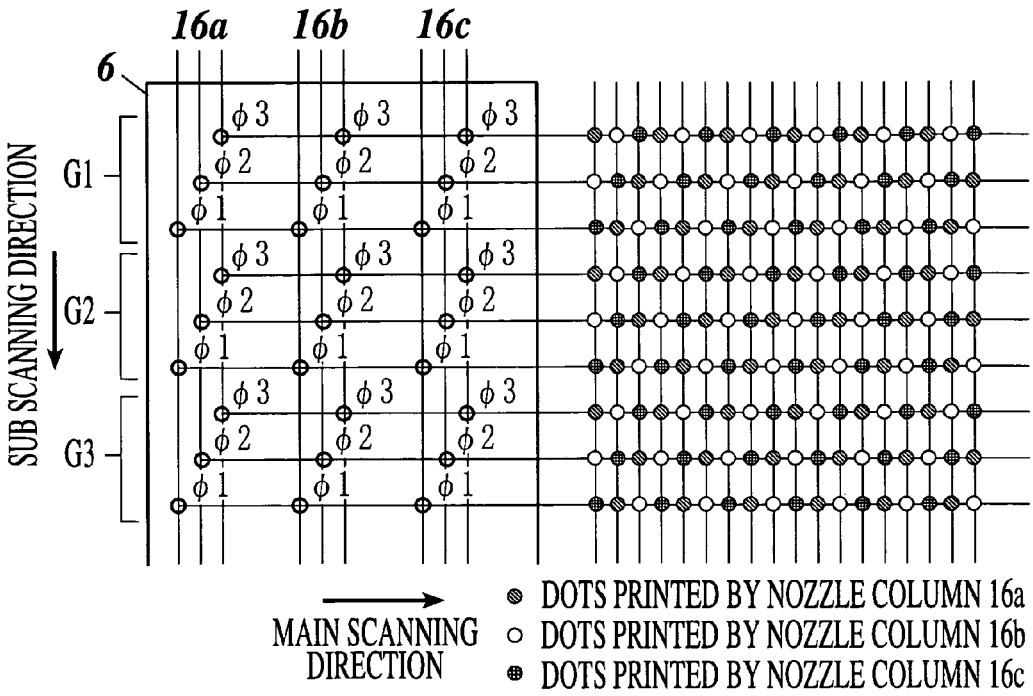
FIG. 19 shows a recording head having three columns of staggered nozzles according to the third embodiment.
Figure 20:
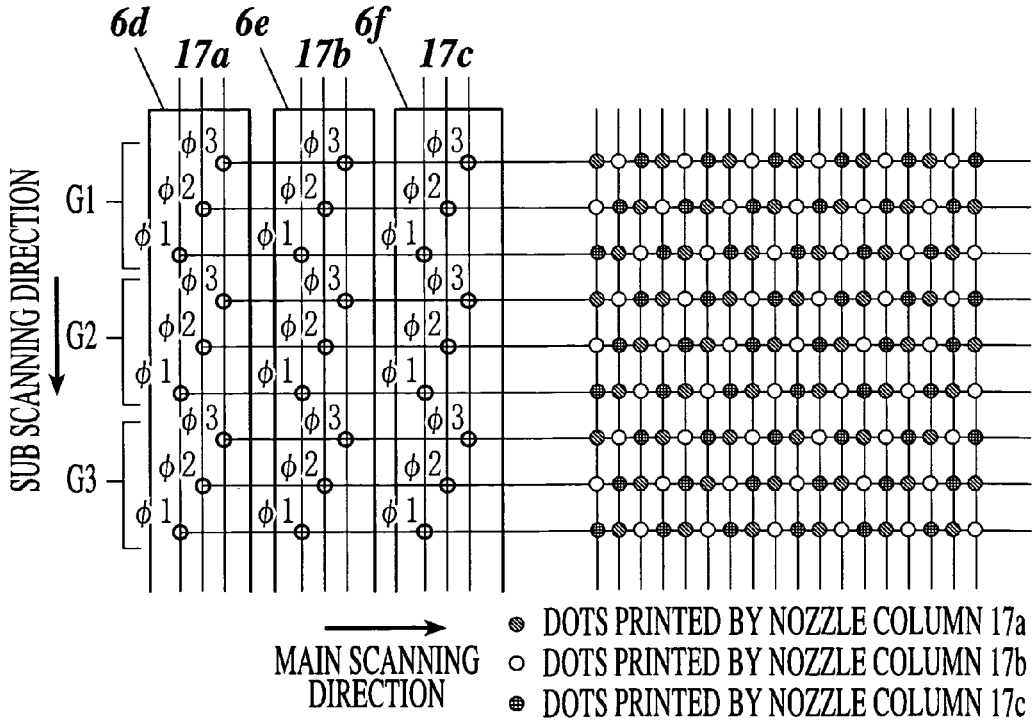
FIG. 20 shows three recording heads, each head having one column of staggered nozzles in the third embodiment.

The third embodiment may be arranged by using staggered nozzles as in the second embodiment. As shown in FIGS. 19 and 20, recording heads 6, and 6*d*, 6*e* and 6*f* are driven with multi-phase drive, and have three staggered nozzle columns 16*a*, 16*b* and 16*c*, and 17*a*, 17*b* and 17*c*, respectively, for jetting the same kind of ink.

Each nozzle on the nozzle columns 16*a*, 16*b* and 16*c*, and 17*a*, 17*b* and 17*c* is positioned on a straight line extending in the main scanning direction. Each distance L between the nozzle columns is set to (a pixel pitch in the main scanning direction) times (n times the number of drive phases plus 1), where n is a natural number.

When the head 6 or the heads 6*d*, 6*e* and 6*f* are, respectively, controlled as shown in FIG. 8 or the like, this structure can effectively achieve the same effects as in the second embodiment. As described in the above third embodiment, the recording head having such staggered nozzles can also record all pixels covered with the recording width of the head by one time scanning in the main scanning direction. Accordingly, the problem of fluctuation in images, which is possible to occur by plural times of scanning as in the second embodiment, can be avoided, thereby obtaining higher quality of images with improved productivity.

In the embodiments shown in FIG. 14 and FIG. 20, the distance L between the nozzle columns is not always set to (pixel pitch) times (n times the number of drive phases plus 1), but, for example, it may be also possible to record on all recorded pixel locations as shown in FIG. 17 and FIG. 20, respectively, by independently inputting drive phases to each head. This method is also applicable to a fourth embodiment described below.

d. Fourth Embodiment

A fourth embodiment of the invention will now be explained with reference to FIGS. 21 through 27.

Figure 21:
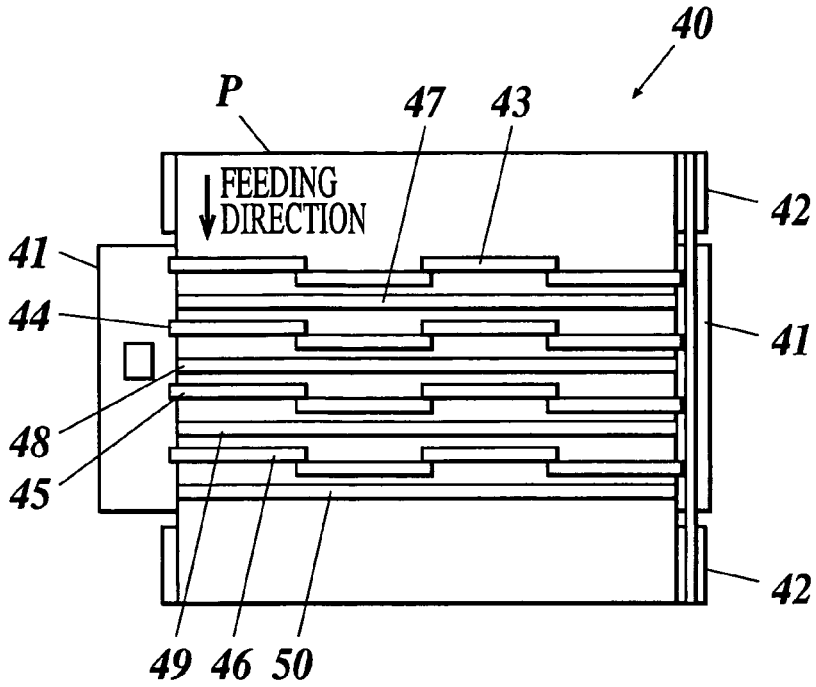
FIG. 21 is a schematic diagram showing the construction of an ink jet recording apparatus according to a fourth embodiment of the invention.

FIG. 21 is a schematic diagram showing the construction of an ink jet recording apparatus according to the present embodiment. The ink jet recording apparatus 40 is a line-type ink jet recording apparatus in which images are formed by jetting of ink during feeding of a recording medium P.

The "upstream" and "downstream" in the line-type ink jet recording apparatus are defined with a feeding direction of a recording medium as a standard. That is, the upstream in the feeding direction is the upper side in FIG. 21, and the downstream in the feeding direction is the lower side in FIG. 21.

As shown in FIG. 21, the ink jet recording apparatus 40 has a platen 41 supporting the medium P thereon. There are provided with feeding devices 42, each including a roller for feeding the medium P, at the upstream and downstream of the platen 41 in the feeding direction of the recording medium P so that the platen 41 is disposed between them. Disposed over the platen 41 are a plurality of recording heads 43, 44, 45 and 46 for jetting respective colored inks (the colors of yellow (Y), magenta (M), cyan (C) and black (K)) on substantially entire width of the medium P, the heads extending in a direction substantially perpendicular to the medium P, and arranged from the upstream to the downstream of the feeding direction of the medium P.

Figure 22:
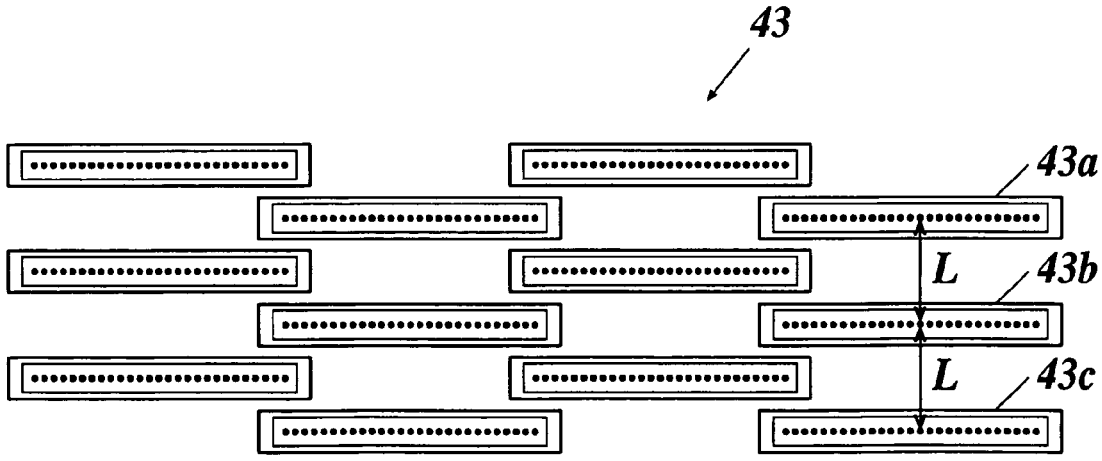
FIG. 22 shows the structure of recording heads for one color on the ink jet recording apparatus in the fourth embodiment.

The recording heads 43, 44, 45 and 46 are so-called line-type heads, and jet inks of yellow, magenta, cyan and black, respectively, in the embodiment. Since the number of drive phases in the embodiment is three, each color of head, for example, the head 43 for yellow ink, as shown in FIG. 22, actually comprises three line heads 43*a*, 43*b* and 43*c* arranged in parallel with each other in the feeding direction, that is, twelve line heads in total constitute a recording head for one color.

Each line head forming the recording head has one row of nozzles, and each nozzle on the three line heads is positioned on a line in the feeding direction. The distance L between the nozzle rows is set to (a pixel pitch in the feeding direction) times (n times the number of drive phases plus 1), where n is a natural number.

In the embodiment, the pixel pitch in the feeding direction is one inch (25400 μm)/720 dpi, for example, the number of drive phases is three and n=1, then (n times the number of drive phases plus 1)=4, and the distance L=141.11 μm. In this embodiment, if n=100 and (n times the number of drive phases plus 1)=301, then the distance L=10619 μm=10.619 mm.

At the downstream side of the recording heads 43, 44, 45 and 46 in the feeding direction of the medium P, provided are irradiating devices 47, 48, 49 and 50, each device extending on substantially entire width of the medium P for curing inks deposited on the medium P by irradiation of light. As a light source provided inside the irradiating device 47 or the like, there may be used a fluorescent lamp, mercury lamp, metal halide lamp or the like for irradiating ultraviolet rays, electron beam, x-rays, visible light, infrared rays or the like, and in the embodiment ultraviolet rays are employed as the light source.

The ink jet recording apparatus 40 of the embodiment, as in the first to third embodiments, preferably uses photo curable ink, including radical polymerized type ink, cationic polymerized type ink and hybrid type ink, which is cured by ultraviolet irradiation. It is particularly preferable in the embodiment to use energy accumulating type cationic polymerized type ink, which is little affected by oxygen in the polymerization reaction and curable by longer irradiation time even if low illuminance of ultraviolet rays are used.

Figure 23:
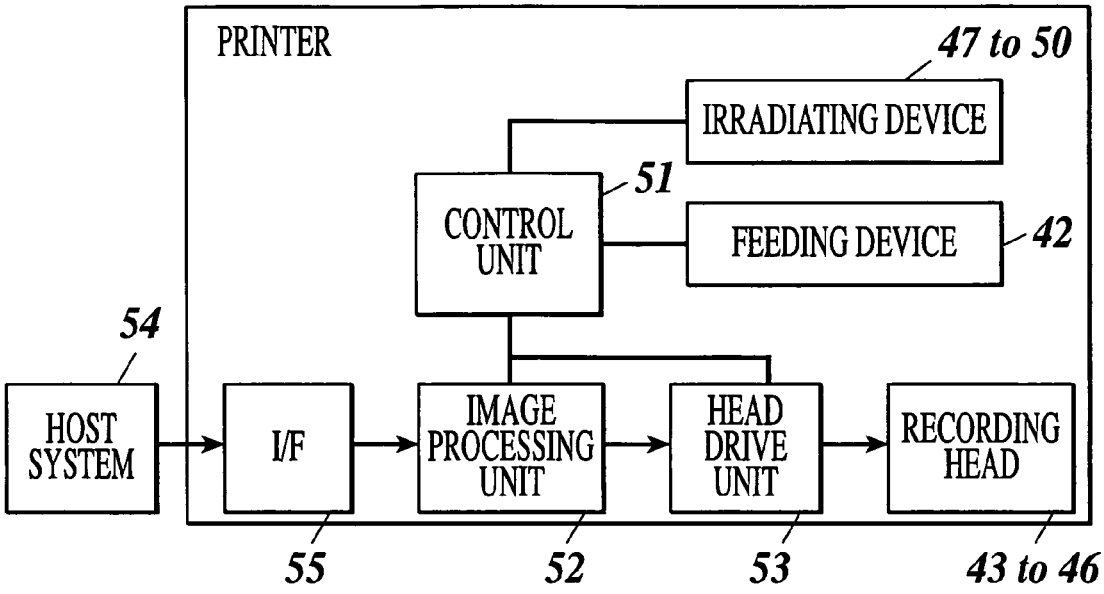
FIG. 23 is a block diagram showing the control configuration of the ink jet recording apparatus in the fourth embodiment.

As shown in FIG. 23, the ink jet recording apparatus of the embodiment comprises a control unit 51. The control unit 51 is electrically connected to an image processing unit 52, a head drive unit 53 for driving the recording heads 43-46, the feeding devices 42 and the irradiating devices 47-50, for controlling each of the configuration units or devices.

The image processing unit 52 functions as in the first to third embodiments, receiving encoded input image data sent from a host system 54 through an interface (I/F) 55, and sends to the head drive unit 53 the image data converted to a data format to be processed by the ink jet recording apparatus 40.

The head drive unit 53 is controlled to jet inks from the nozzles of the recording heads 43 to 46 by applying to piezoelectric elements of the recording heads 43 to 46 pulse voltage to record the data relating to the recorded image obtained from the image processing unit 52 based on the signals sent from the control unit 51.

The feeding devices 42 comprise feed motors and feed rollers (both not shown) for being rotatably driven to feed the recording medium P by a unit of predetermined feed amount, and actuation of the feed motors by the control unit 51 allows the medium P to be fed during image recording.

The control unit 51 comprises CPU, ROM and RAM (none of them shown), and processing programs stored in the ROM are developed and stored into the RAM to be executed by the CPU. The control unit 51 controls the feeding devices 42 for feeding the medium P in the feeding direction during image recording. The control unit 51 further sends to the head drive unit 53 command signals, such as the driving frequency set by the host system 54 or the external apparatus, and causes the head drive unit 53 to apply pulse voltages to the respective piezoelectric elements of the recording heads 43-46 based on given image recording information for jetting ink from the nozzles on the recording heads 43-46 by a predetermined period.

Figure 24:
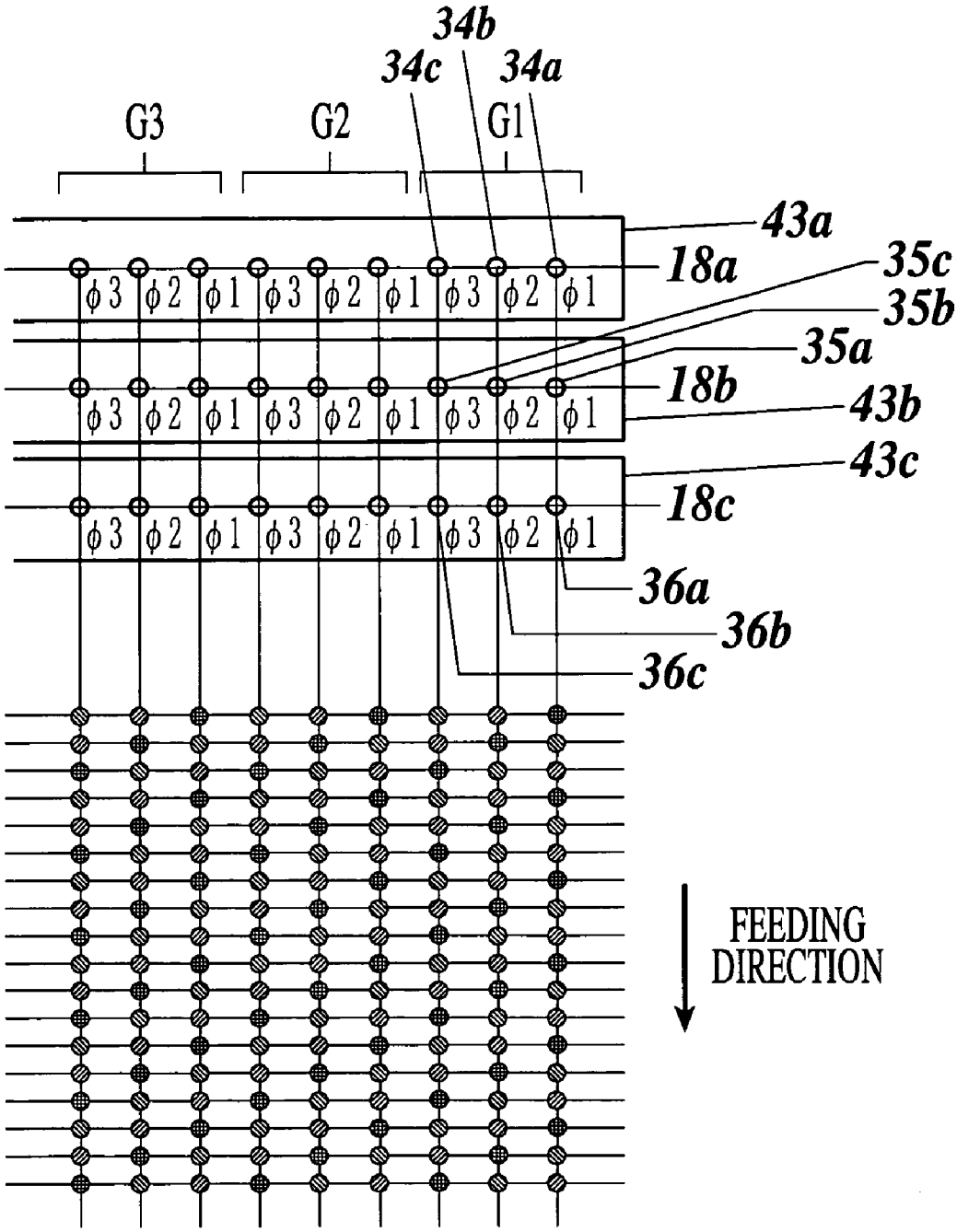
FIG. 24 is a partially enlarged view of the recording head of FIG. 22.

The ink jetting from nozzles on one nozzle row is controlled by the control unit 51 in the same manner as in the third embodiment described above (see FIG. 3). In FIG. 24 which is a partially enlarged view of line heads 43*a*, 43*b* and 43*c* of FIG. 22, a nozzle 34*a* on the nozzle row 18*a*, a nozzle 35*a* on the nozzle row 18*b* and a nozzle 36*a* on the nozzle row 18*c* are controlled to simultaneously jet inks in phase 1, and similarly, nozzles 34*b*, 35*b* and 36*b* in phase 2 and nozzles 34*c*, 35*c* and 36*c* in phase 3.

In this embodiment, as the control of the ink jetting from nozzles shown in FIG. 3, the ink jetting from nozzles is controlled to start at the position shifted in the feeding direction by one time the pixel width (one pixel) in every phase. This is also the same as in the third embodiment.

That is, in the embodiment, STB 1 shown in FIG. 3 corresponds to a strobe pulse for switching the phase at the nozzles 34*a*, 35*a* and 36*a*, STB 2 at the nozzles 34*b*, 35*b* and 36*b*, and STB 3 at the nozzles 34*c*, 35*c* and 36*c*. Respective phases of the nozzles 34*a* to 36*c* are switched at either timing in the strobe pulse width. This phase switching corresponds to a frequency, and the strobe pulse width corresponds to a period of each phase.

A description will now be given of an ink jet recording method according to the invention, using the ink jet recording apparatus 40 in the embodiment.

Initially, when the control unit 51 receives predetermined image recording information from the host system 54 or the external apparatus, the control unit 51 determines recorded pixel locations at each phase switching of the heads 43-46 so that the recorded pixel locations for the nozzles can be shifted by integer times the pixel width of recording resolution in the feeding direction (every one time the pixel width, or one pixel width in the embodiment), and moves the recording medium P up to a record starting position.

Subsequently, the control unit 51 makes the recording medium P carried in the feeding direction with the drive phase switched by a pixel width as shown in FIG. 3, to jet ink from the nozzles 34*a* through 36*c* of the recording heads 43 to 46, thereby recording on different recorded pixel locations from one another by the ink jetting from the nozzles on different rows 18*a*, 18*b* and 18*c* of the recording heads 43 to 46.

At this time, inks are jetted on respective recorded pixel locations as shown in FIGS. 15A-15D. All nozzles of the three rows record respective pixels as shown in FIG. 24.

According to the ink jet recording apparatus 40 in the embodiment and its recording method, recorded result shown in FIG. 24 is quite the same as that shown in FIG. 17 in the third embodiment except that primary movement is the main scanning direction in FIG. 17 and the feeding direction in FIG. 24. The reason for the same result is: one set of three line heads 43*a*, 43*b* and 43*c*, which constitutes the recording head 43 in the embodiment, is basically the same construction as in the third embodiment, which is composed of three heads 6*a*, 6*b* and 6*c* having respective one of the nozzle columns 15*a*, 15*b* and 15*c* formed thereon, and controlled in the same manner.

Thus, the fourth embodiment achieves the same actions and effects as in the third embodiment.

However, in the case that line-type recording heads are used as in the embodiment, the heads do not scan over the medium P, and therefore the ink jet recording apparatus has to be so constructed that all pixels are recorded when the medium P passes under the recording heads 43-46. That is, as described in the third embodiment, such a recording method can not be employed that a first scanning records half of the entire pixels and next scanning records the rest of the pixels.

As alternatives in the embodiment, the ink jet recording apparatus may have appropriate structures. For example, one head may have three rows of aligned nozzles formed thereon, instead of one set of three line heads, the head may have staggered nozzles, or the head may have double the nozzle rows, six rows, with 3-phase drive.

These alternative structures can also attain the same effects as in the present embodiment and the third embodiment. That is, if one set of three line heads shown in FIG. 24 is transformed into one head having three rows of three aligned nozzles formed thereon (not shown), it would be easily understood that the same effects as in the present embodiment and the third embodiment can be achieved.

Figure 25:
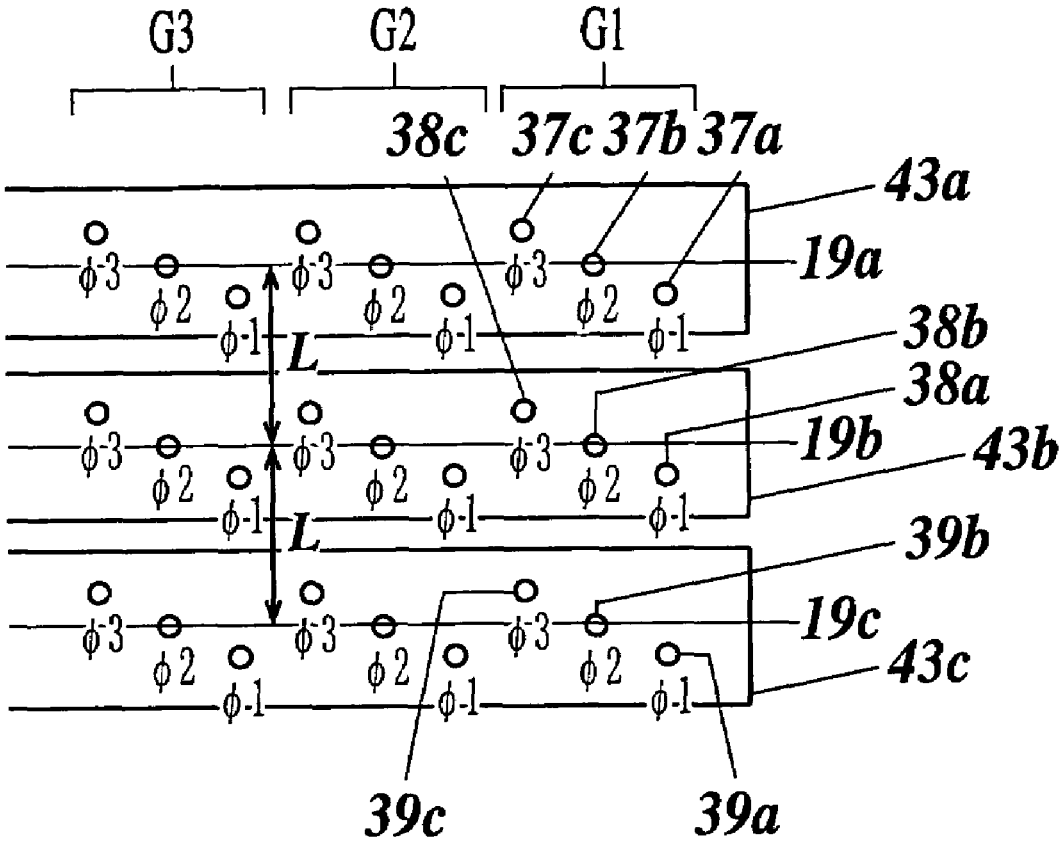
FIG. 25 is a partially enlarged view of a recording head having staggered nozzles in the ink jet recording apparatus according to the fourth embodiment.

Let it be assumed that each nozzle line formed on three line heads 43*a*, 43*b* and 43*c* shown in FIG. 22 may be replaced with a staggered nozzle row as shown in FIG. 25. The nozzles are staggered in the feeding direction for each drive phase, and each nozzle on nozzle rows 19*a*, 19*b* and 19*c* is positioned in a line in the feeding direction. Each distance L between the nozzle rows is set to (a pixel pitch in the feeding direction) times (n times the number of drive phases plus 1), where n is a natural number.

Nozzles 37*a* through 39*c* on the nozzle rows 19*a*, 19*b* and 19*c* are driven with 3-phase drive, and with the phase sequentially switched from the nozzles at the downstream side in the feeding direction (37*a*, 38*a* and 39*a*, and the like in this case).

Figure 26C:
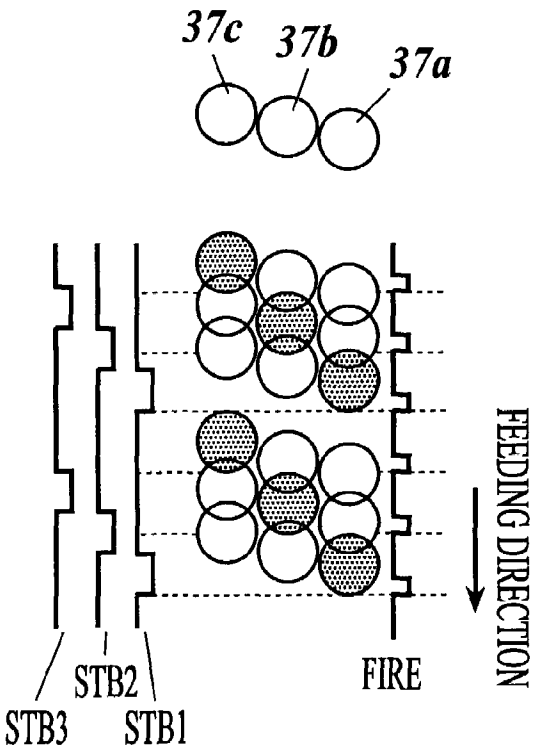
FIGS. 26A to 26C show a sequence of recorded pixels and strobe pulses in the case that the staggered nozzles of FIG. 25 are driven with three-phase drive and three times of interleaving.
Figure 26B:
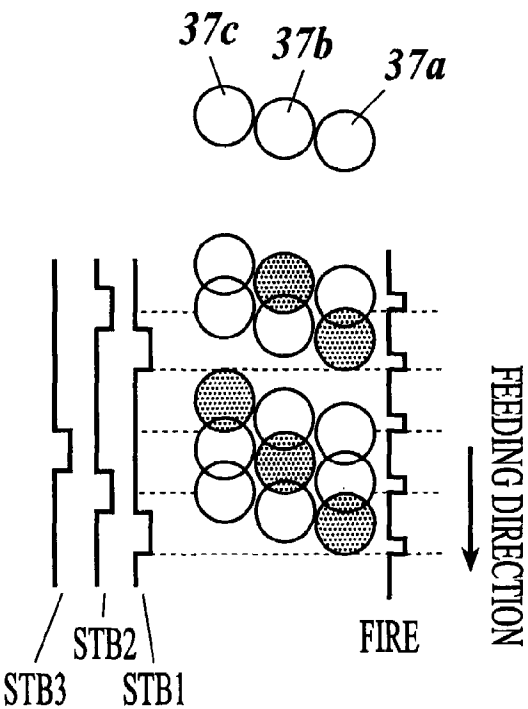
Figure 26A:
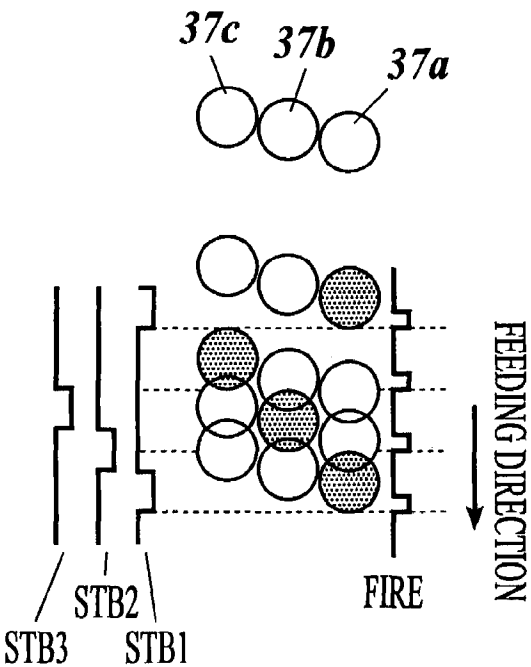

For example, when nozzles 37*a*, 37*b* and 37*c* fixed in position jet inks in this order on the recording medium fed under the nozzles, pixels are recorded as shown in FIGS. 26A to 26C in time sequence. Resultantly, pixels for each nozzle are recorded with two pixels spaced as in FIG. 8, and pixels between the nozzles are contiguous to each other in the feeding direction for respective phases.

Figure 27:
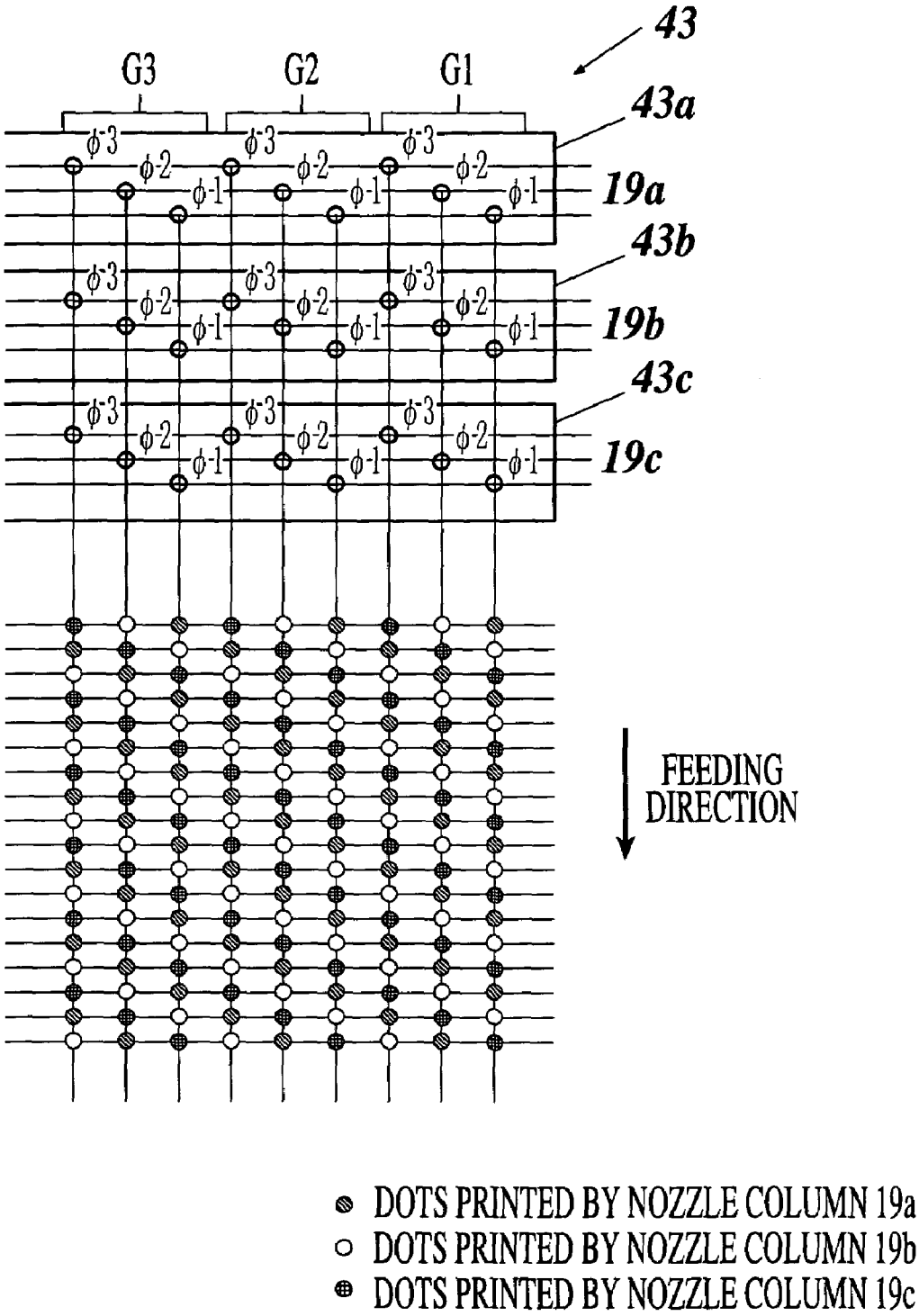
FIG. 27 shows recorded pixels recorded by a recording method using staggered nozzles in the fourth embodiment.

Nozzles 38*a*, 38*b* and 38*c* on the nozzle row 19*b* record pixels contiguous to the pixels recorded by the nozzles 37*a*, 37*b* and 37*c* in the feeding direction, because the nozzles 38*a*, 38*b* and 38*c* and corresponding nozzles on the row 19*a* are, respectively, spaced by the pixel pitch times (n times the number of drive phases plus 1). Nozzles 39*a*, 39*b* and 39*c* further record pixels next to the recorded pixels. Thus, all pixels are recorded on the medium fed under the facing surface of the recording head 43 as shown in FIG. 27.

As described above, the ink jet recording apparatus comprising line-type recording heads can also attain the same effects as in the second embodiment, as well as the effects in the third and the present embodiments.

The entire disclosure of Japanese Patent Application Nos. 2004-207594 which was filed on Jul. 14, 2004 and 2004-354221 which was filed on Dec. 7, 2004 is incorporated into the present invention in its entirety.

What is claimed is:

1. An ink jet recording apparatus comprising:

a serial-type recording head comprising a plurality of nozzles to jet ink;

a main scanning mechanism to reciprocate the recording head in a main scanning direction;

a feeding device to feed a recording medium in a sub scanning direction perpendicular to the main scanning direction; and a control unit to control jetting of the ink from the nozzles of the recording head so that the recording head is driven with multi-phase drive to record with recorded pixel locations shifted at every drive phase switching by an integer times a pixel width of a recording resolution in the main scanning direction, and to perform recording by scanning the recording head a plurality of times with the recording medium fed by the feeding device;

wherein the control unit controls the ink jetting such that a recorded pixel location X which indicates where a recorded pixel is located from a reference position in the main scanning direction when an arbitrary pixel as the reference position is set to 1 is given by $$X=\{(i-1)\times f+P-1\}\times D+1, \text{ and}$$

a number of scanning S of the recording head is given by $$S=f\times D\times R_p/R_n$$

or $$S=f\times D\times P_n/P_p$$

where:

i is a number of a pixel when counted from the reference position out of pixels recorded by the same nozzle in the main scanning direction, D is the shifted number of pixels in the main scanning direction at every phase of recorded pixels (by a unit of the number of pixels in the recording resolution), f is the number of head-drive phases, P is a drive phase number (a phase number allotted from P=1 to P=f in the order of drive, designating a drive phase to record a pixel at the reference position as P=1), S is the number of scanning of the recording head, $R_n$ is a resolution of the head in the sub scanning direction, $R_p$ is a recording resolution in the sub scanning direction, $P_n$ is a mean pitch between adjacent nozzles in the sub scanning direction, and $P_p$ is a recorded pixel pitch in the sub scanning direction.

2. An ink jet recording apparatus comprising:

a serial-type recording head comprising a plurality of nozzles to jet ink;

a main scanning mechanism to reciprocate the recording head in a main scanning direction;

a feeding device to feed a recording medium in a sub scanning direction perpendicular to the main scanning direction; and a control unit to control jetting of the ink from the nozzles of the recording head so that the recording head is driven with multi-phase drive to record with recorded pixel locations shifted at every drive phase switching by an integer times a pixel width of a recording resolution in the main scanning direction, and to perform recording by scanning the recording head a plurality of times with the recording medium fed by the feeding device;

wherein the nozzles of the recording head are staggered so that the nozzles are displaced in the main scanning direction for every drive phase;

wherein the control unit switches the drive phases such that, when a period to switch each drive phase is given by T, a clock period to record a pixel by T', and the number of drive phases by f, then $$T=T'\times\{(D-1)+(f-1)/f\}.$$

3. An ink jet recording apparatus comprising:

line-type recording heads each comprising a plurality of nozzles formed thereon to jet ink;

a feeding device to feed a recording medium in a feeding direction; and a control unit to control jetting of the ink from the nozzles of each of the recording heads so that the recording heads are driven with multi-phase drive to record with recorded pixel locations shifted at every drive phase switching by an integer times a pixel width of a recording resolution in the feeding direction, and to perform record recording by the plurality of recording heads with the recording medium fed by the feeding device;

wherein the nozzles of each of the recording heads are staggered so that the nozzles are displaced in the feeding direction for every drive phase; and wherein the control unit switches the drive phases such that, when a period to switch each drive phase is given by T, a clock period to record a pixel by T', and the number of drive phases by f, then $$T=T'\times\{(D-1)+(f-1)/f\}.$$

4. An ink jet recording method comprising:

switching drive phases of a serial-type recording head comprising a plurality of nozzles formed thereon;

determining recorded pixel locations with the pixel locations to be recorded by the nozzles of the recording head shifted at every drive-phase switching of the recording head by an integer times a pixel width of a recording resolution in a main scanning direction; and jetting ink from the nozzles of the recording head to record on the recorded pixel locations while scanning the recording head plural times in the main scanning direction with the recording medium fed by the feeding device;

wherein the determining of the recorded pixel locations is performed such that a recorded pixel location X which indicates where a recorded pixel is located from a reference position in the main scanning direction when an arbitrary pixel as the reference position is set to 1 is given by $$X=\{(i-1)\times f+P-1\}\times D+1, \text{ and}$$

a number of scanning S of the recording head is given by $$S=f\times D\times R_p/R_n$$

or $$S=f\times D\times P_n/P_p$$

where i is a number of a pixel when counted from the reference position out of pixels recorded by the same nozzle in the main scanning direction, D is the shifted number of recorded pixels in the main scanning direction at every phase (by a unit of the number of pixels in the recording resolution), f is the number of head-drive phases, P is a drive phase number (a phase number allotted from P=1 to P=f in the order of drive, designating a drive phase to record a pixel at the reference position as P=1), S is the number of scanning of the recording-head, $R_n$ is a resolution of the head in the sub scanning direction, $R_p$ is a recording resolution in the sub scanning direction, $P_n$ is a mean pitch between adjacent nozzles in the sub scanning direction, and $P_p$ is a recorded pixel pitch in the sub scanning direction.

5. An ink jet recording method comprising:

switching drive phases of a serial-type recording head comprising a plurality of nozzles formed thereon;

determining recorded pixel locations with the pixel locations to be recorded by the nozzles of the recording head shifted at every drive-phase switching of the recording head by an integer times a pixel width of a recording resolution in a main scanning direction; and jetting ink from the nozzles of the recording head to record on the recorded pixel locations while scanning the recording head plural times in the main scanning direction with the recording medium fed by the feeding device;

wherein the jetting of the ink is performed so that the ink is jetted from staggered nozzles arranged on the recording head with the nozzles displaced in the main scanning direction for every drive phase; and wherein the switching of the drive phases is performed such that, when a period to switch each drive phase is given by T, a clock period to record a pixel by T', and the number of drive phases by f, then $$T=T'\times\{(D-1)+(f-1)/f\}.$$

6. An ink jet recording method comprising:

switching drive phases of a line-type recording head comprising a plurality of nozzles formed thereon;

determining recorded pixel locations with the pixel locations to be recorded by the nozzles of the recording head shifted at every drive-phase switching of the recording head by an integer times a pixel width of a recording resolution in a feeding direction; and jetting ink from the nozzles of the recording head to record on the recorded pixel locations with the recording medium fed in the feeding direction;

wherein the jetting of the ink is performed so that the ink is jetted from staggered nozzles arranged on the recording head with the nozzles displaced in the feeding direction for every drive phase;

wherein the switching of the drive phases is performed such that, when a period to switch each drive phase is given by T, a clock period to record a pixel by T', and the number of drive phases by f, then $$T=T'\times\{(D-1)+(f-1)/f\}.$$

* * * * *